US010338501B2

(12) United States Patent
Kudo et al.

(10) Patent No.: US 10,338,501 B2
(45) Date of Patent: Jul. 2, 2019

(54) IMAGE FORMING APPARATUS

(71) Applicant: CANON KABUSHIKI KAISHA, Tokyo (JP)

(72) Inventors: Ran Kudo, Tokyo (JP); Fukashi Hatano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/148,220

(22) Filed: Oct. 1, 2018

(65) Prior Publication Data

US 2019/0033753 A1 Jan. 31, 2019

Related U.S. Application Data

(63) Continuation of application No. PCT/JP2017/014884, filed on Apr. 5, 2017.

(30) Foreign Application Priority Data

Apr. 5, 2016 (JP) ..... 2016-076130

(51) Int. Cl.
*G03G 15/00* (2006.01)
*G03G 15/08* (2006.01)
(Continued)

(52) U.S. Cl.
CPC ..... *G03G 15/095* (2013.01); *G03G 15/0886* (2013.01); *G03G 21/12* (2013.01); *G03G 21/169* (2013.01)

(58) Field of Classification Search
CPC .. G03G 15/095; G03G 15/0886; G03G 21/12; G03G 21/169
See application file for complete search history.

(56) References Cited

U.S. PATENT DOCUMENTS 8,855,523 B2 10/2014 Udagawa
8,862,018 B2 10/2014 Suzuki et al.
(Continued)

FOREIGN PATENT DOCUMENTS

JP 3-43670 U 4/1991
JP 2008-286820 A 11/2008
(Continued)

OTHER PUBLICATIONS

Search Report and Written Opinion dated May 23, 2017, in PCT/JP2017/014884.

*Primary Examiner* — David M. Gray
*Assistant Examiner* — Michael A Harrison
(74) *Attorney, Agent, or Firm* — Venable LLP

(57) ABSTRACT

An image forming apparatus includes a guiding portion that acts on a shutter member to open and close the shutter member when a unit, including the shutter member, is mounted to and dismounted from a main assembly. The guiding portion includes an opening operating portion that moves the shutter member from the closing position to the opening position in interrelation with an inserting operation of the unit, a closing operating portion that moves the shutter member from the opening position to the closing position in interrelation with an extracting operation of the unit, and a shutter closing portion contacted to the shutter member at a position upstream of the opening operating portion and the closing operating portion, with respect to an inserting direction of the unit relative to the guiding portion, to move the shutter member from the opening position to the closing position in interrelation with the inserting operation.

10 Claims, 20 Drawing Sheets

(51) Int. Cl.

| | |
|---|---|
| ***G03G 21/12*** | (2006.01) |
| ***G03G 21/16*** | (2006.01) |
| ***G03G 15/095*** | (2006.01) |

(56) References Cited

U.S. PATENT DOCUMENTS

| | | | | |
|---|---|---|---|---|
| 9,213,301 | B2 | 12/2015 | Kudo et al. | |
| 2006/0210319 | A1* | 9/2006 | Katsuyama ..... | G03G 15/0875 399/260 |
| 2006/0285885 | A1* | 12/2006 | Lee ..... | G03G 15/0867 399/262 |
| 2007/0269237 | A1* | 11/2007 | Sato ..... | G03G 15/0875 399/260 |

FOREIGN PATENT DOCUMENTS

| | | | |
|---|---|---|---|
| JP | 2009-122345 | A | 6/2009 |
| JP | 2012-177745 | A | 9/2012 |
| JP | 2013-050553 | A | 3/2013 |
| JP | 2015-064503 | A | 4/2015 |

* cited by examiner (a)

(b)

(a)

(b)

(a)

(b)

(a)

(b)

(a)

(b)

(a)

(b)

(a)

(b)

(a)

(b)

(a)

(b)

(c)

IMAGE FORMING APPARATUS

FIELD OF THE INVENTION

The present invention relates to an image forming apparatus, such as a copying machine, a printing machine, and a facsimile apparatus, that uses an electrophotographic image forming method or an electrostatic recording method.

BACKGROUND ART

An image forming apparatus which uses an electrophotographic image forming method or an electrostatic recording method employs an endless belt as an image bearing member for bearing a toner image. For example, an image forming apparatus of the so-called intermediary transfer type employs an intermediary transfer belt, which is an endless belt onto which a toner image is transferred from two or more photosensitive members. Further, this type of image forming apparatus is provided with a belt cleaning apparatus for removing transfer residual toner (toner remaining on intermediary transfer belt after image transfer from belt) and other unnecessary residues (which also are referred to as residual toner, hereafter). A belt cleaning apparatus has a cleaning member for removing toner from the surface of the intermediary transfer belt; a container (casing) in which removed toner is stored and so on. The container is provided with a toner discharge opening, through which toner is discharged from the container and is sent to a storing apparatus (box for storing recovered toner).

Some belt cleaning apparatuses are structured so that they can be installed, as a part of a belt unit, into the main assembly of an image forming apparatus, or uninstalled, as a part of a belt unit, from the main assembly of an image forming apparatus. A belt unit is made up of an endless belt, and two or more rollers by which the endless belt is suspended and tensioned. Others may be structured so that they can be installed into, or uninstalled from, the main assembly of an image forming apparatus, without involving a belt unit.

If the toner discharge opening of the casing of the belt cleaning apparatus is left open when a belt cleaning apparatus is uninstalled, as an integral part of a belt unit, from the main assembly of an image forming apparatus, or uninstalled alone from the main assembly of an image forming apparatus, it sometimes occurs that toner scatters from the casing of the belt cleaning apparatus. In order to prevent the occurrence of this problem, some belt cleaning apparatuses are provided with a shutter for blocking the toner discharge opening of the casing. There is disclosed, in Japanese Laid-open Patent Application No. 2009-122345, a combination of an image forming apparatus and a cleaning apparatus therefor, structured so that, if the shutter member is open, a stopper prevents the belt cleaning apparatus from being uninstalled from the main assembly of the image forming apparatus.

This structural arrangement, however, requires an operator to open the shutter after the installation of a belt cleaning apparatus into the main assembly of an image forming apparatus, or to close the shutter before uninstalling the belt cleaning apparatus. Thus, this structural arrangement complicates the operation for installing, or uninstalling, the belt cleaning apparatus.

It is possible to structure a combination of an image forming apparatus and belt cleaning apparatus therefor so that as the belt cleaning apparatus is installed into, or uninstalled from, the main assembly of the image forming apparatus, the shutter is opened, or closed, respectively, by the movement of the belt cleaning apparatus. For example, it is possible to structure the combination so that when the belt cleaning apparatus is outside the main assembly of the image forming apparatus, the shutter is kept pressed in the blocking direction by a spring or the like, whereas as the belt cleaning apparatus is installed into the main assembly, the shutter comes under such force that is directed to open the shutter, and therefore, is kept open.

However, it has become evident that if a combination of an image forming apparatus and belt cleaning apparatus therefor is structured as described, the following problem arises. That is, as the belt cleaning apparatus is inserted into the main assembly of the image forming apparatus, the shutter is moved in the direction to unblock the toner discharge opening. Thereafter, the shutter remains under the force generated in the direction to press the shutter in the direction to block the toner discharge opening. This force affects the rotational movement of an intermediary transfer belt, in some cases. For example, it is possible that this force will affect the belt supporting-tensioning rollers and frame, by which the belt cleaning apparatus is supported, in their positional accuracy (whether or not they are parallel to each other). In particular, in a case where a belt cleaning apparatus is provided with a cleaning member, and is structured so that the cleaning member is pressed against a tension roller for adjusting an intermediary transfer roller in tension, with the presence of the intermediary transfer belt between the cleaning member and tension roller, the tension roller is sometimes changed in position by the force described above. If the tension roller is changed in position, the intermediary transfer belt is changed in tension. That is, the intermediary transfer belt is not provided with a preset amount of tension. Thus, it cannot be assured that the intermediary transfer belt rotates at a preset speed. Further, in a case where a belt unit is structured so that a tension roller doubles as a steering roller which automatically controls the belt deviation in terms of position, with the utilization of the balance in friction between the lengthwise end portions of the belt, the force described above becomes a large amount of load upon the steering operation of the tension roller, causing sometimes the tension roller to fail to properly steer the belt.

The earnest studies made by the inventors of the present invention regarding the issues discussed above revealed that structuring a combination of an image forming apparatus and belt cleaning apparatus therefor so that even when the belt cleaning apparatus is out of the main assembly of the image forming apparatus, the shutter can be held in a position in which it keeps the toner discharge opening unblocked, or a position in which it keeps the toner discharge opening blocked, and also, so that the shutter is opened or closed by the movement of the belt cleaning apparatus, which occurs as the belt cleaning apparatus is installed into, or uninstalled from, the main assembly of the image forming apparatus. This structural arrangement has its own issue. That is, if the shutter is already in its closed position for some reason or another when the belt cleaning apparatus is inserted into the main assembly of an image forming apparatus, it becomes sometimes impossible to insert the belt cleaning apparatus into the normal installation completion position. Moreover, it sometimes occurs that while the belt cleaning apparatus is inserted into the main assembly, toner falls out of the casing through the toner discharge opening, and contaminates the interior of the main assembly.

Means for Solving the Problem

According to one aspect, the invention provides an image forming apparatus comprising a unit detachably mounted on a main assembly of said apparatus and including a belt, a cleaning device, a shutter member and a holding member, wherein said belt is an endless belt and is stretched around a plurality of stretching rollers, wherein said cleaning device includes a cleaning member for removing toner from said belt and a container for accommodating the toner removed from said belt and provided with a discharge opening, wherein said shutter member is movable between an opening position for opening said discharge opening and a closing position for closing said discharge opening to open and close said discharge opening, wherein said holding member holds said shutter member at the opening position or the closing position, and a guiding portion for guiding said unit and actable on said shutter member to open and close said shutter member when said unit is mounted to and dismounted from said main assembly, wherein said guiding portion includes an opening operating portion, a closing operating portion, and a shutter closing portion, wherein said opening operating portion is contacted to said shutter member to move said shutter member from the closing position to the opening position in interrelation with an inserting operation of said unit relative to said guiding portion, wherein said closing operating portion is contacted to said shutter member to move said shutter member from the opening position to the closing position in interrelation with an extracting operation of said unit from said guiding portion, and wherein, when said unit is inserted relative to said guiding portion while said shutter member is in the opening position, said shutter closing portion is contacted to said shutter member at a position upstream of said opening operating portion and said closing operating portion, with respect to an inserting direction of said unit relative to said guiding portion, to move said shutter member from the opening position to the closing position in interrelation with the inserting operation.

Figure 5:
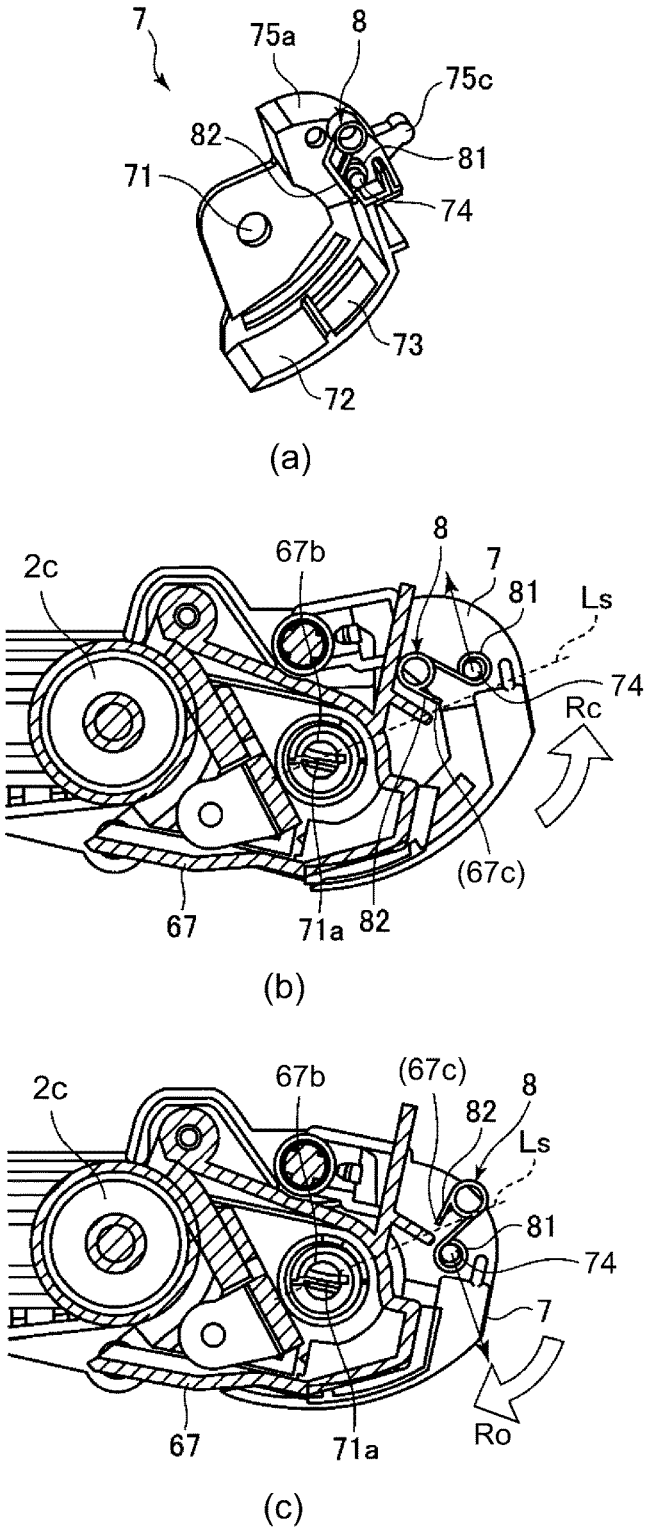

Part (a) of FIG. 5 is a perspective view of the shutter; part (b) of FIG. 5, a sectional view of the shutter; and part (c) of FIG. 5 also is a sectional view of the shutter.

Figure 6:
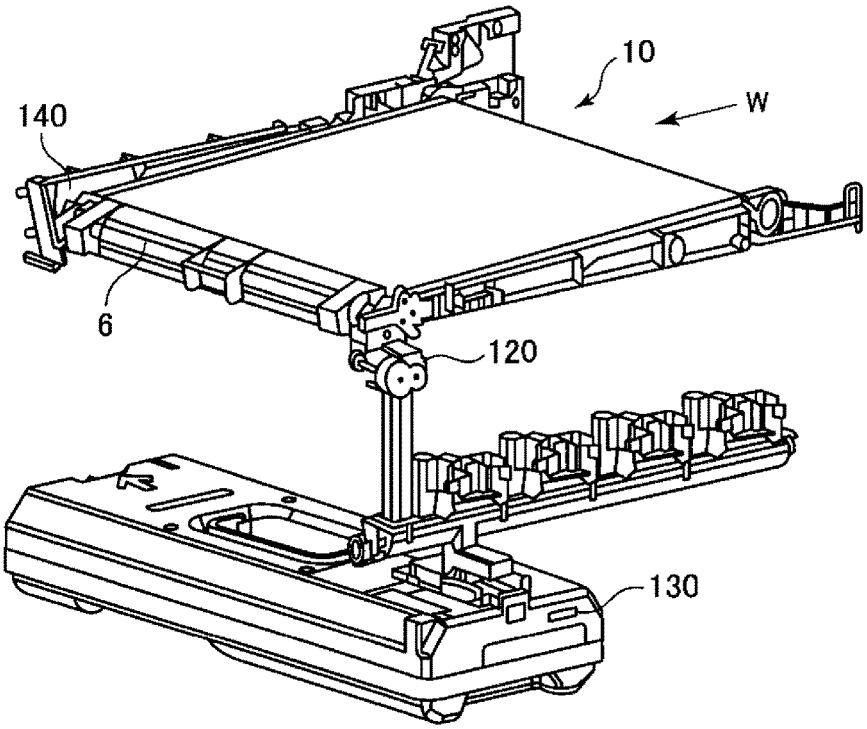

FIG. 6 is a perspective view of a combination of the belt cleaning apparatus, toner conveyance passage, and storing apparatus; it shows the state of connection between the belt cleaning apparatus and toner conveyance passage.

Figure 7:
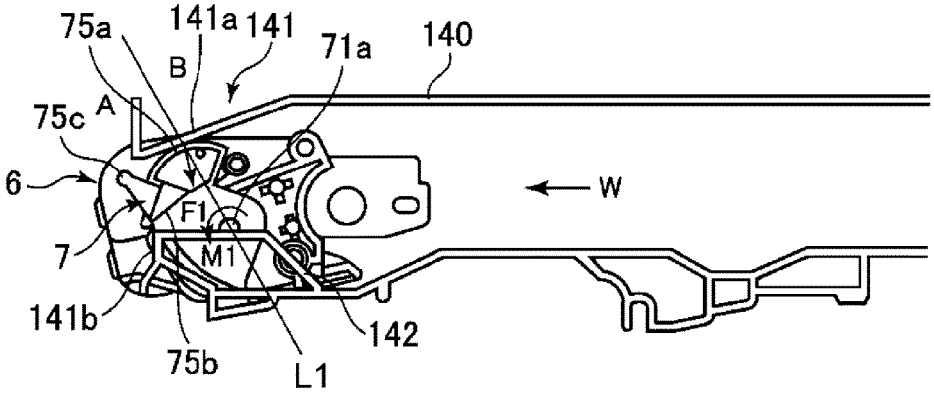
Figure 7:
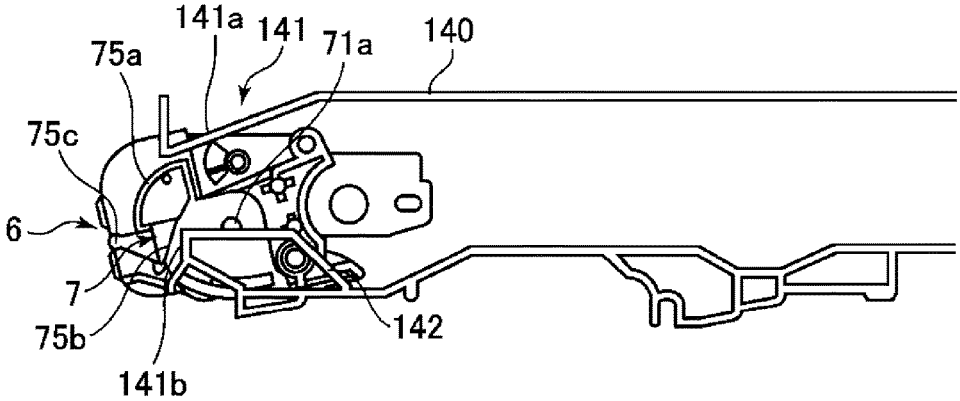

Part (a) of FIG. 7 and part (b) of FIG. 7 are sectional views of the shutter and its adjacencies; they show the shutter movement which occurs while the belt cleaning apparatus is inserted into the main assembly of the image forming apparatus.

Figure 8:
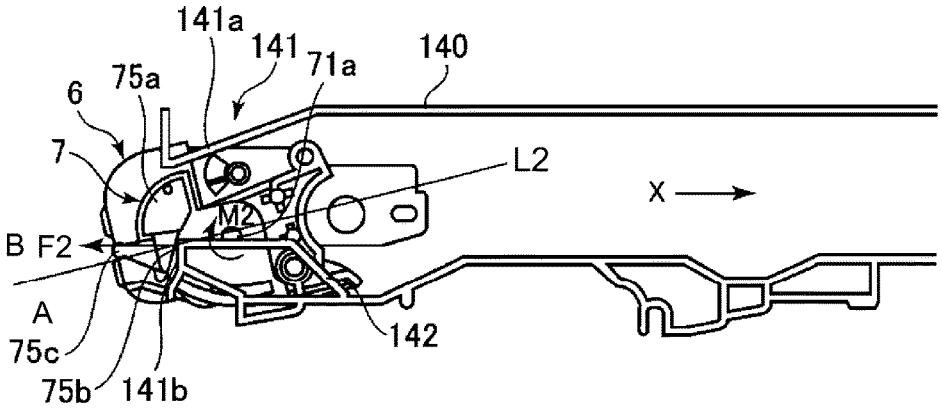
Figure 8:
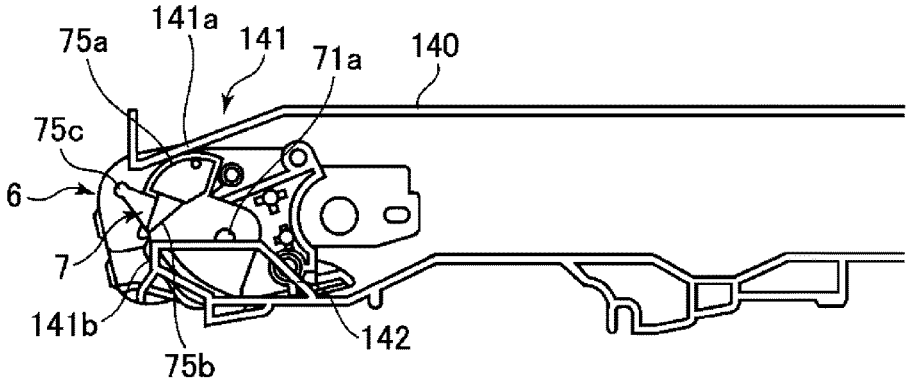

Part (a) of FIG. 8 and part (b) of FIG. 8 are sectional views of the shutter and its adjacencies; they show the shutter movement which occurs while the belt cleaning apparatus is pulled out of the main assembly of the image forming apparatus.

Figure 9:
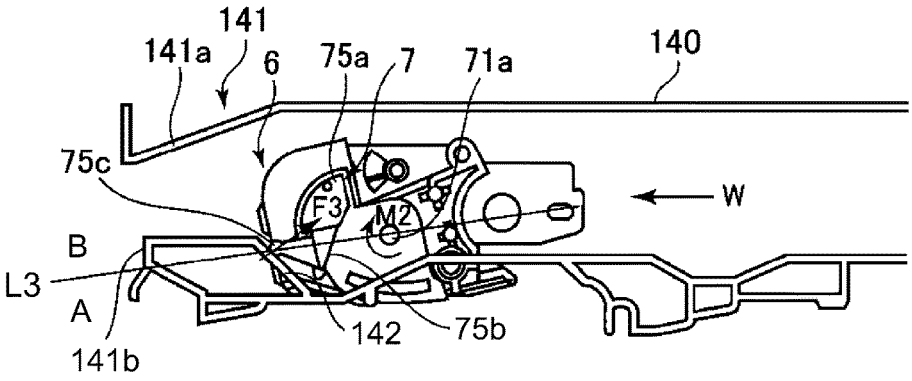
Figure 9:
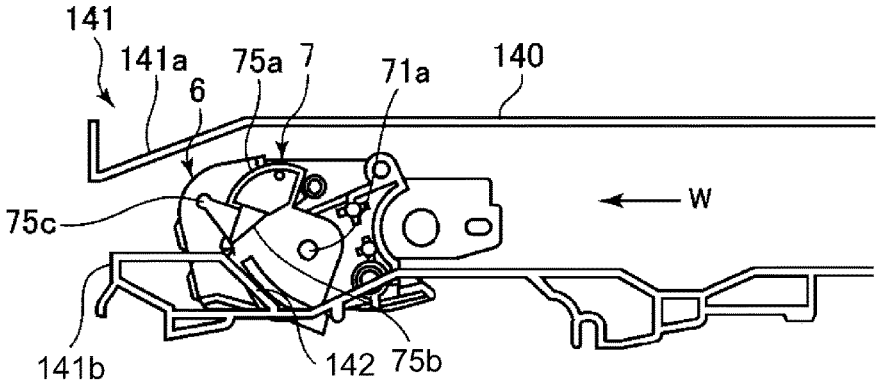

Parts (a) and (b) of FIG. 9 are sectional views of the shutter and its adjacencies; they show the shutter movement which occurs as the belt cleaning apparatus is inserted into the main assembly of the image forming apparatus, with the shutter remaining in its open position.

Figure 10:
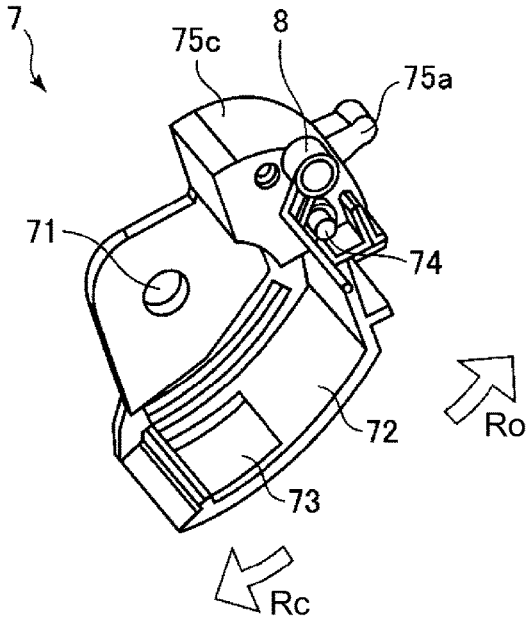

FIG. 10 is a perspective view of the shutter.

Figure 11:
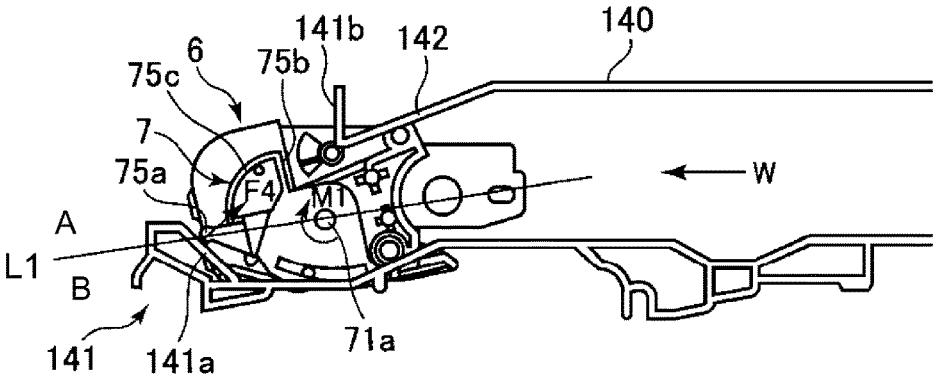
Figure 11:
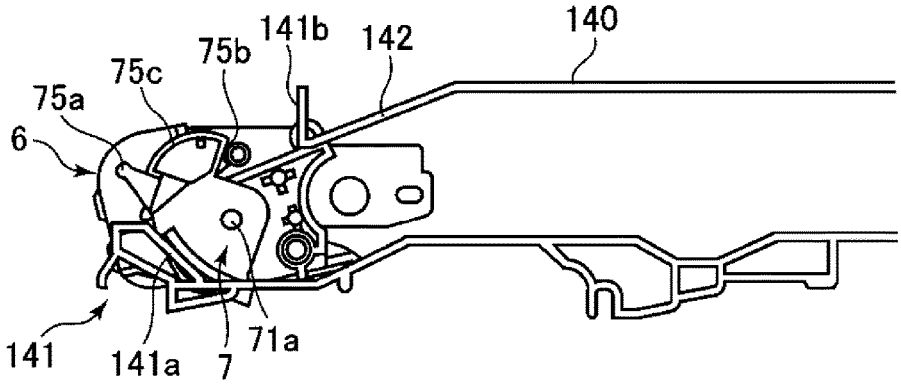

Parts (a) and (b) of FIG. 11 are sectional view of the shutter and its adjacencies; they show the shutter movement which occurs while the belt cleaning apparatus is inserted into the main assembly of the image forming apparatus.

Figure 12:
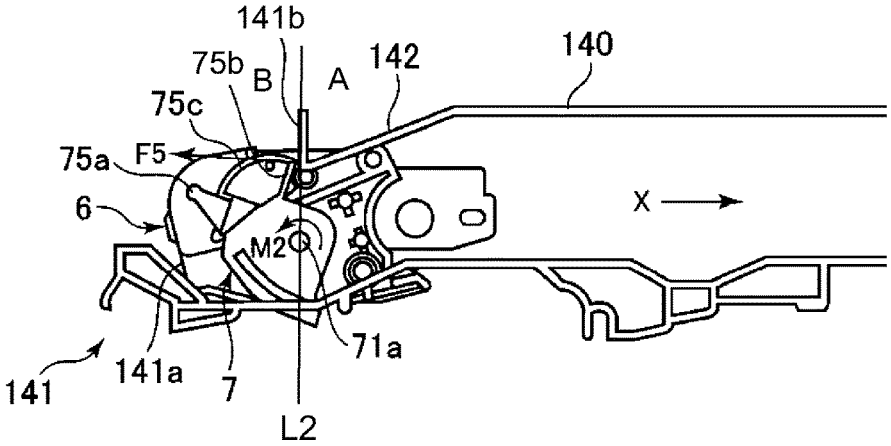
Figure 12:
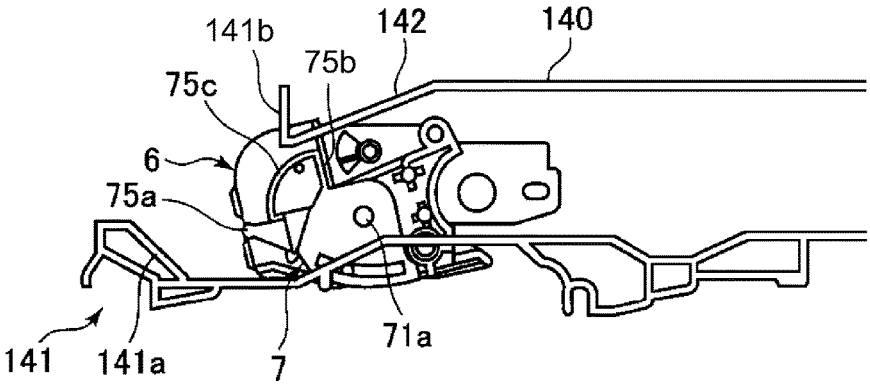

Parts (a) and (b) of FIG. 12 are sectional views of the shutter and its adjacencies; they show the shutter movement which occurs while the belt cleaning apparatus is inserted into the main assembly of the image forming apparatus.

Figure 13:
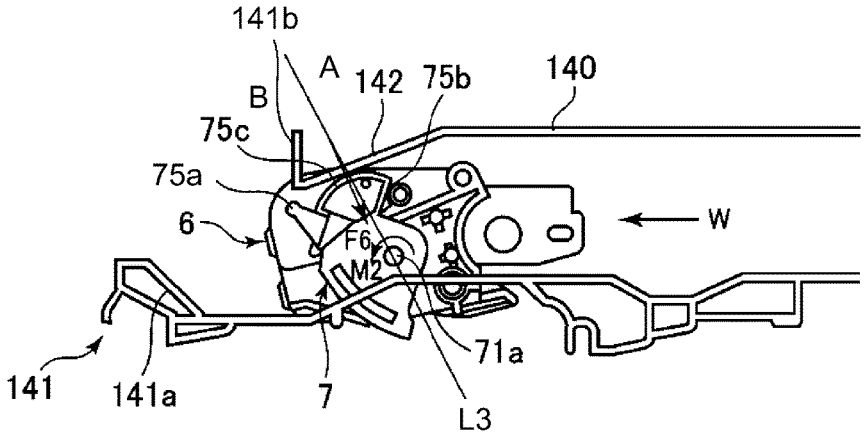
Figure 13:
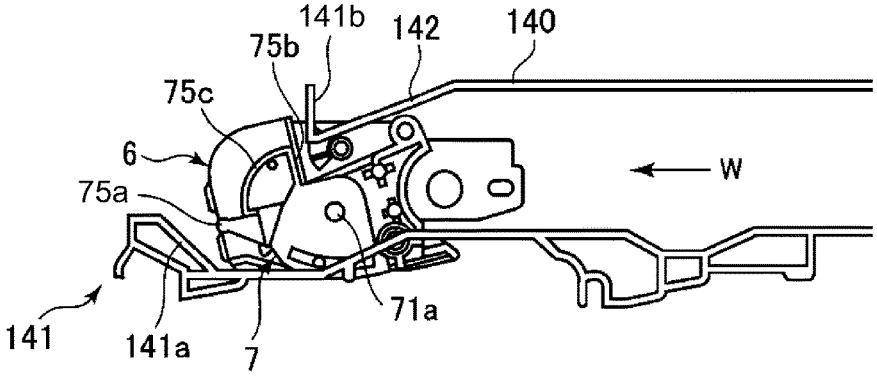

Parts (a) and (b) of FIG. 13 are sectional views of the shutter and its adjacencies; they show the shutter movement which occurs while the belt cleaning apparatus is inserted into the main assembly of the image forming apparatus, with the shutter remaining in its open position.

Figure 14:
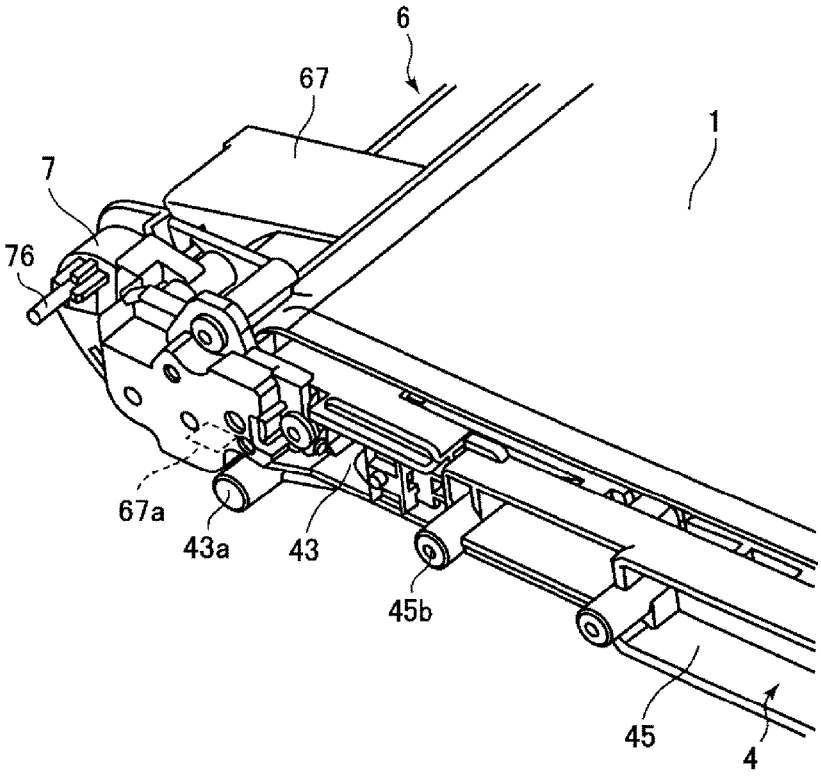

FIG. 14 is a perspective view of the shutter and its adjacencies.

Figure 15:
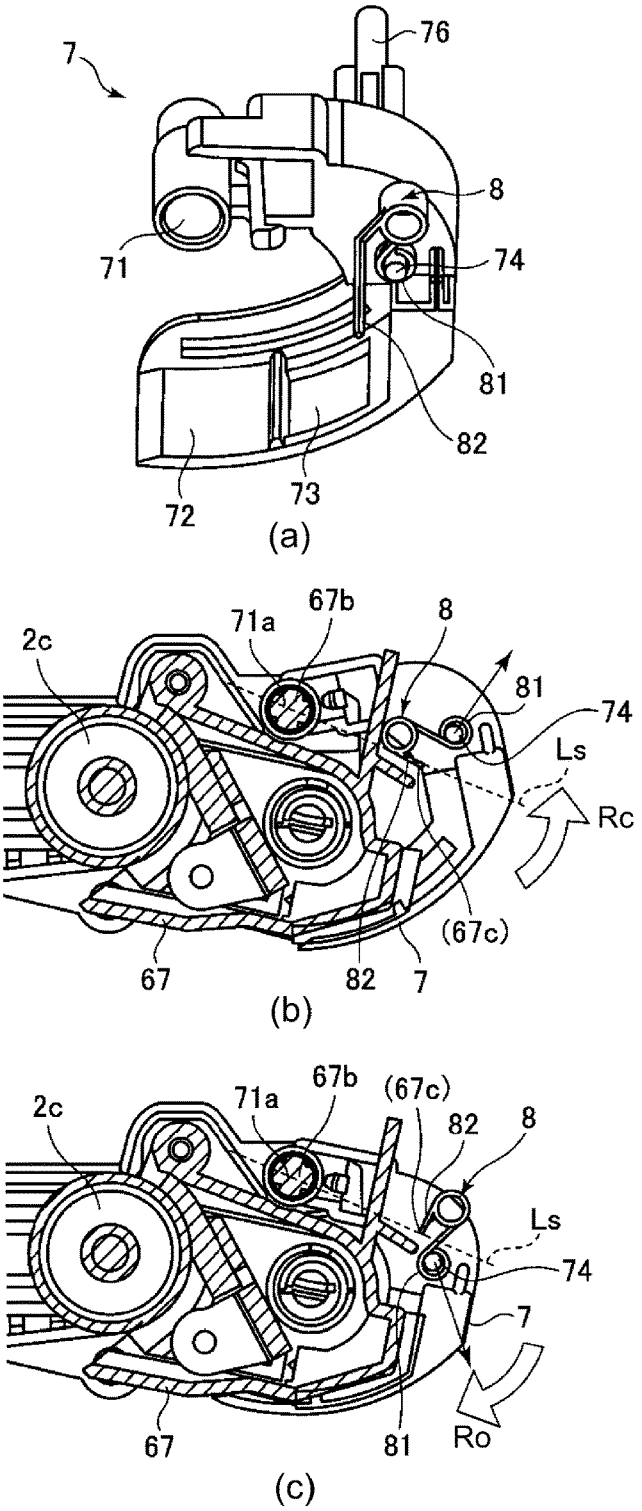

Parts (a), (b) and (c) of FIG. 15 are perspective and sectional views, respectively, of the shutter.

Figure 16:
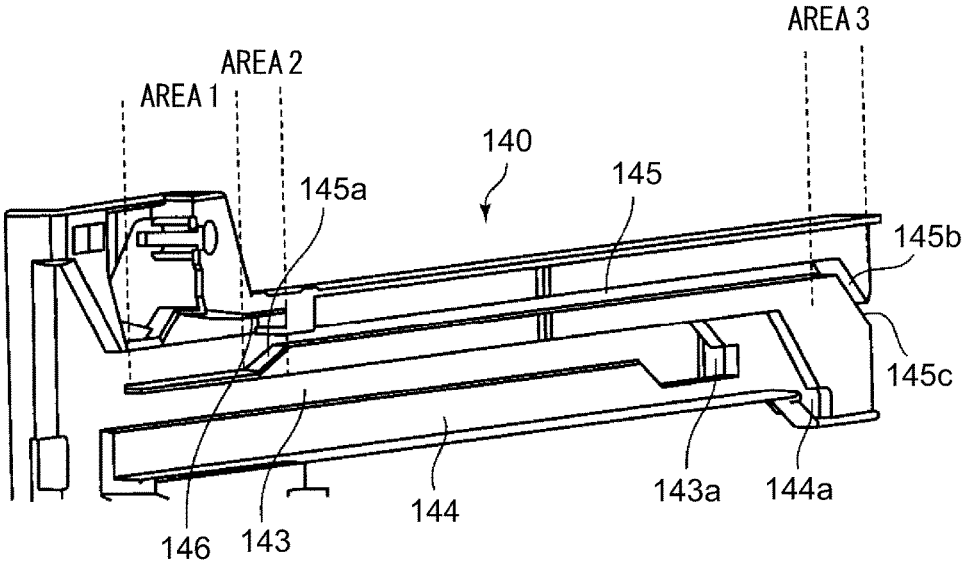
Figure 16:
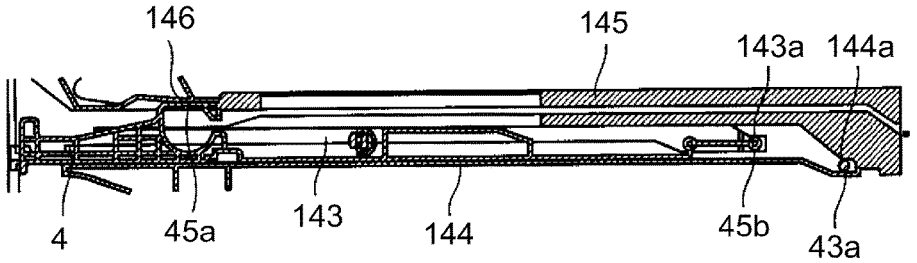

Parts (a) and (b) of FIG. 16 are perspective and sectional views, respectively, of the rail.

Figure 17:
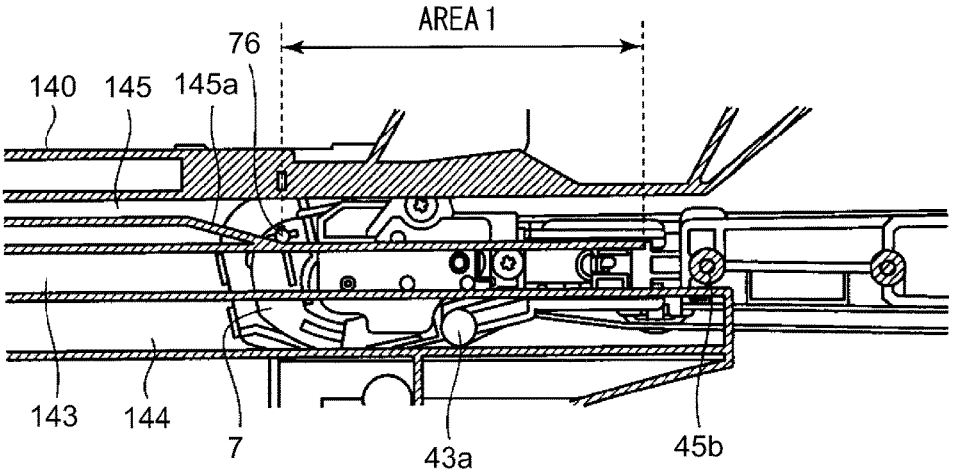
Figure 17:
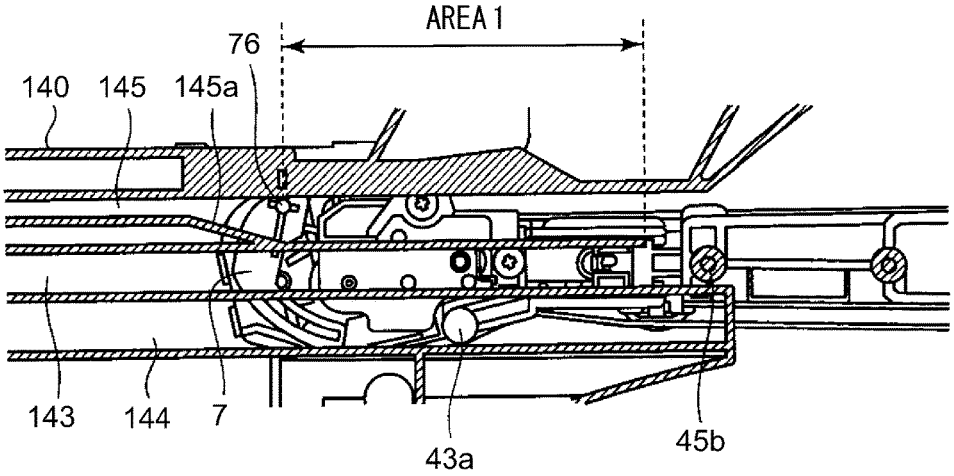

Part (a) and (b) of FIG. 17 are sectional views of a combination of the belt unit, rail, and their adjacencies when the shutter guiding shaft is in the area 1 of the rail.

Figure 18:
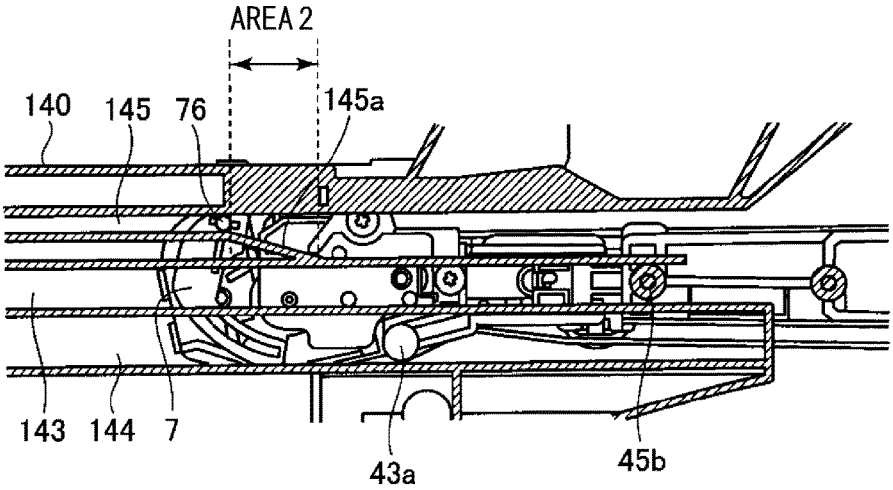

FIG. 18 is a sectional view of the combination of the belt unit, rail, and their adjacencies when the shutter guiding shaft is in the area 2 of the rail.

Figure 19:
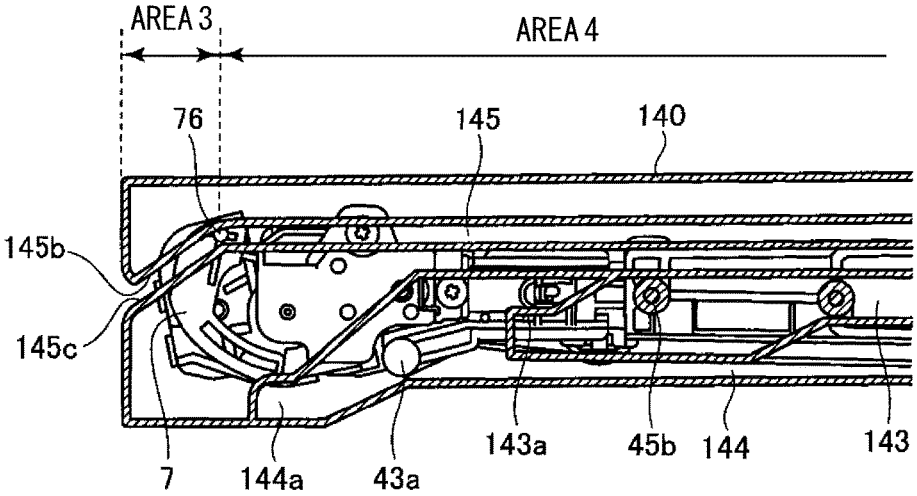

FIG. 19 is a sectional view of the combination of the belt unit, rail, and their adjacencies when the shutter guiding shaft moves into the area 3 of the rail from the area 2 of the rail.

Figure 20:
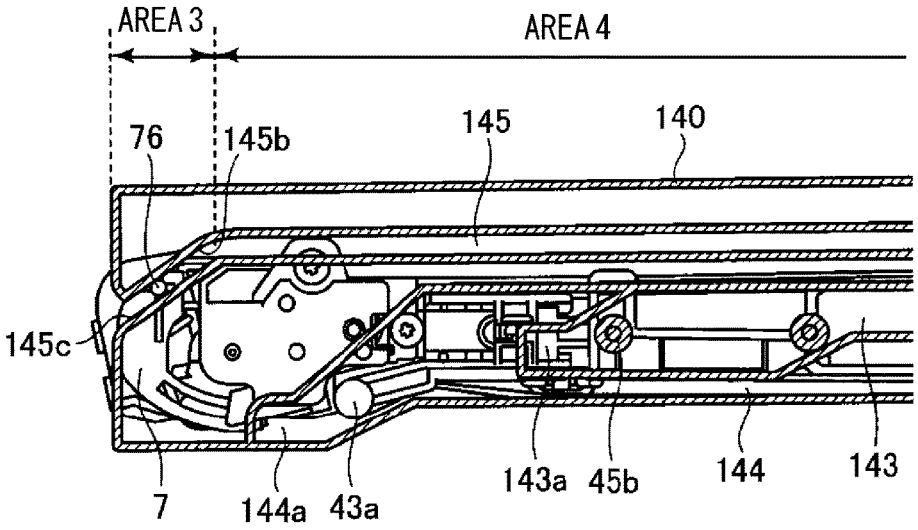

FIG. 20 is a sectional view of the combination of the belt unit, rail, and their adjacencies when the shutter guiding rail is in the area 3 of the rail.

Figure 21:
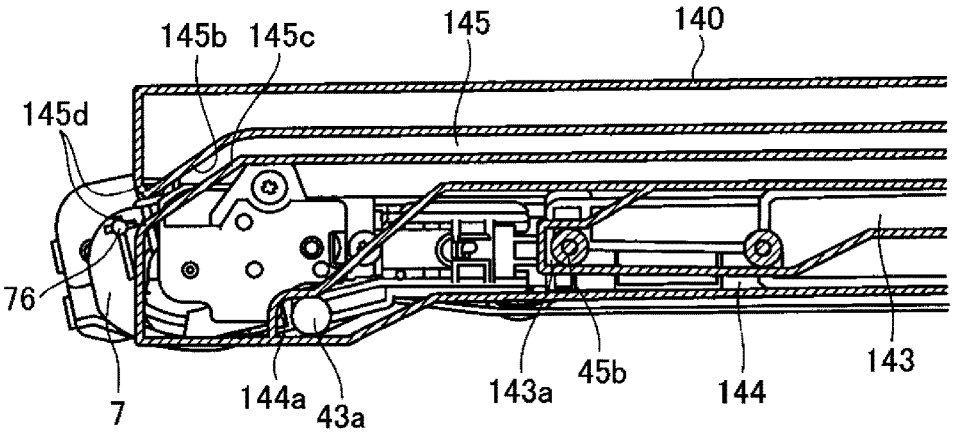

FIG. 21 is a sectional view of the combination of the belt unit, rail, and their adjacencies after the insertion of the intermediary transfer belt unit into the insertion completion position.

Figure 22:
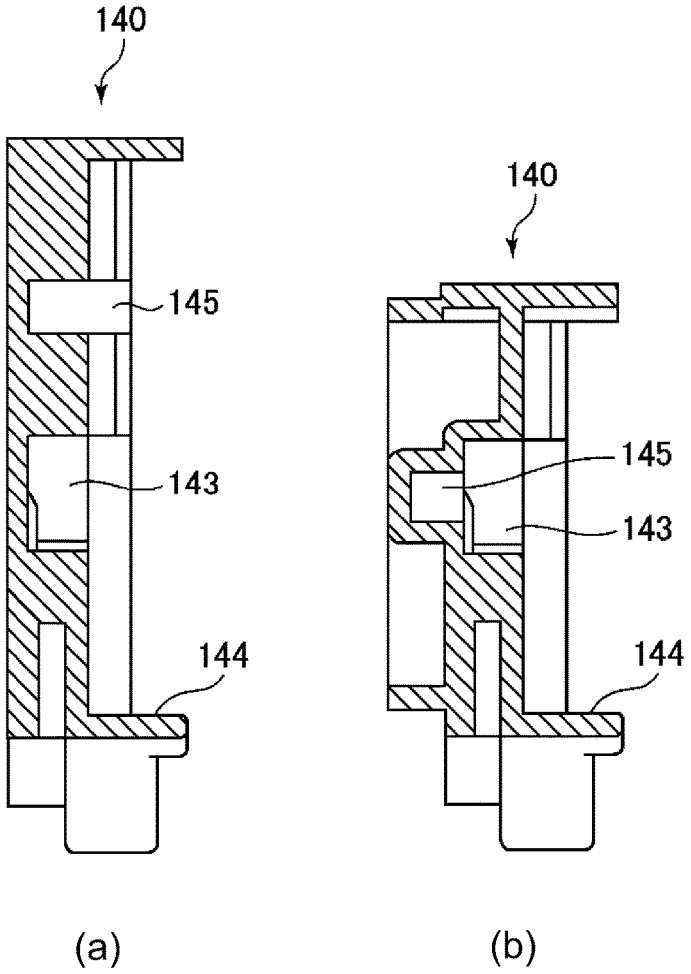

Parts (a) and (b) of FIG. 22 are sectional views of the rail as the rail is seen from the direction parallel to the direction in which the intermediary transfer belt unit is inserted into the main assembly of the image forming apparatus.

Figure 23:
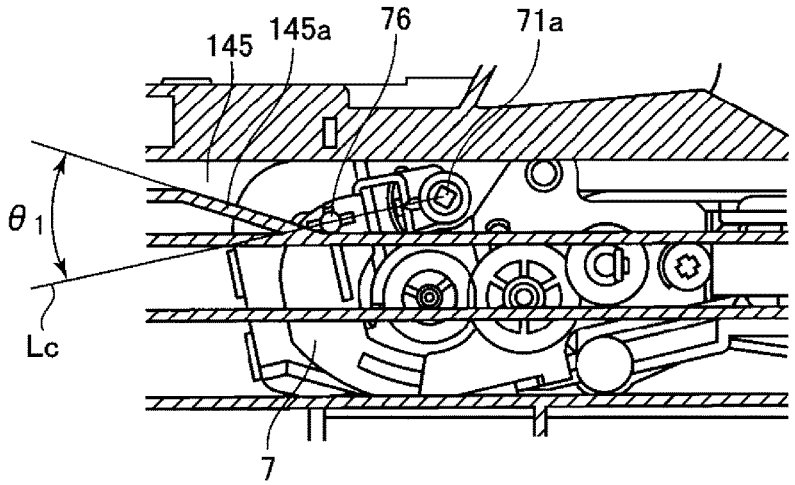
Figure 23:
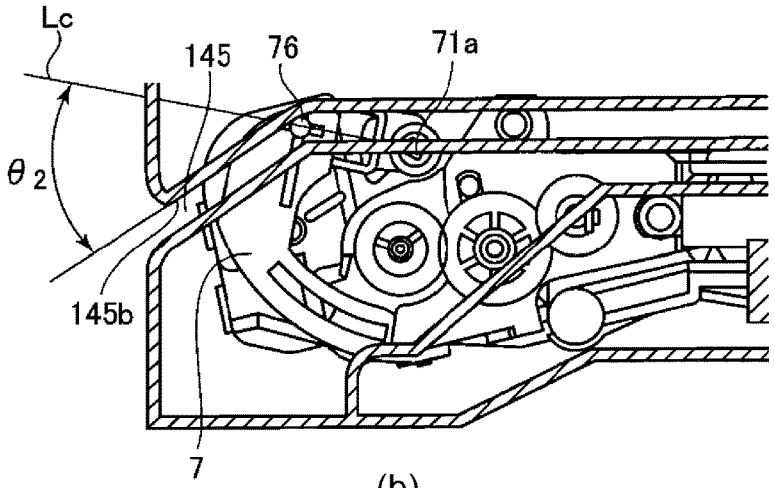
Figure 23:
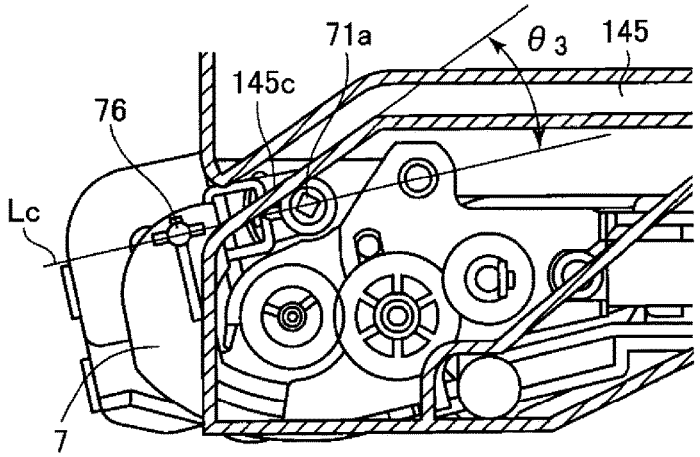

Parts (a), (b) and (c) of FIG. 23 are sectional views of a combination of the belt unit, rail, and their adjacencies; they are for describing the angles of the surfaces of the first, second, and third areas of the rail.

DESCRIPTION OF THE EMBODIMENTS

Hereinafter, the present invention is described in greater detail with reference to the appended drawings of the image forming apparatuses which are in accordance with the present invention.

Embodiment 1

1. Overall Structure and Operation of Image Forming Apparatus

Figure 1:
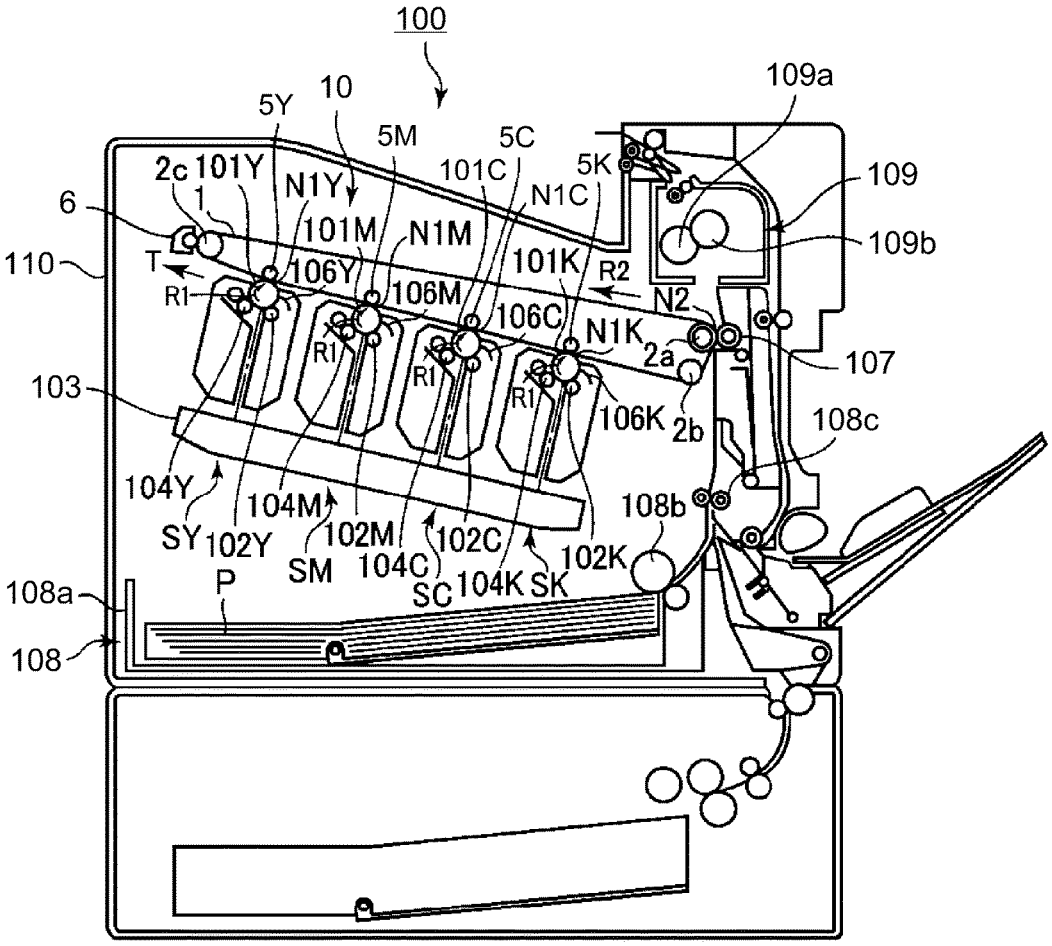
FIG. 1 is a schematic view of a typical image forming apparatus to which the present invention is applicable.

FIG. 1 is a schematic view of the image forming apparatus 100 in this embodiment. The image forming apparatus 100 in this embodiment is a laser beam printer of the so-called intermediary transfer type, and also, of the so-called tandem type. It is capable of forming a full-color image with the use of an electrophotographic image forming method.

The image forming apparatus 100 has multiple image forming portions, more specifically, the first, second, third, and fourth image forming portions SY, SM, SC, and SK, which form yellow (Y), magenta (M), cyan (C), and black (K) images, respectively. Hereafter, the elements of these four image forming portions SY, SM, SC, and SK, which are the same in function and structure, may sometimes be described together, by abbreviating their suffixes which indicate the colors of the images they form. In this embodiment, the image forming portion S is made up of a photosensitive drum 101, a charge roller 102, an exposing apparatus 103, a developing apparatus 104, a primary transfer roller 105, a drum cleaning apparatus 106, and so on.

The photosensitive drum 101 is a photosensitive member (electrophotographic photosensitive member). It is the first image bearing member, which is in the form of a drum (cylindrical). It is rotationally driven in the direction indicated by an arrow mark R1 in the drawing. As the photosensitive drum 101 is rotated, its peripheral surface is uniformly charged to a preset potential level and a preset polarity (negative in this embodiment) by the charge roller 102, as a charging means, which is in the form of a roller. The charged portion of the peripheral surface of the photosensitive drum 101 is scanned by (exposed to) a beam of laser light emitted, while being modulated according to the information regarding the image to be formed, by the exposing apparatus 103 (laser scanner), as an exposing means. Consequently, an electrostatic latent image (electrostatic image) is formed on the peripheral surface of the photosensitive drum 101. In this embodiment, the image forming apparatus 100 is structured so that the exposing apparatus 103 is a unit of each image forming portion, which is for exposing the photosensitive drum 101. After being formed on the peripheral surface of the photosensitive drum 101, the electrostatic latent image is developed into a visible image by the developing apparatus 104, with the use of toner as developer. As a result, a toner image (image formed of toner) is formed on the peripheral surface of the photosensitive drum 101. In this embodiment, it is the points of the peripheral surface of the photosensitive drum 101, which were charged, and then, were reduced (in absolute value) in potential level by being exposed, that toner, the polarity of which is the same as the polarity (negative in this embodiment) to which the peripheral surface of the photosensitive drum 101 is charged (reversal development), is adhered.

The image forming apparatus 100 is provided with an intermediary transfer belt unit 10 (which hereafter may be referred to simply as belt unit), which is in the form of a unit removably mountable in the main assembly 110 of the image forming apparatus 100 (which hereafter will be referred to as apparatus main assembly 110). The intermediary transfer belt 1 is disposed so that it opposes the corresponding photosensitive drum 101. The belt unit 10 has an intermediary transfer belt 1, as the second image bearing member, which is an intermediary transferring member in the form of an endless belt. The belt unit 10 is disposed so that its intermediary transfer belt 1 opposes the photosensitive drum 101 of each image forming portion S. The intermediary transfer belt 1 is suspended and tensioned by multiple suspending-tensioning rollers, more specifically, a driving roller 2*a*, an idler roller 2*b*, and a tension roller 2*c*. The belt unit 10 is structured so that as the driving roller 2*a* is rotationally driven, the intermediary transfer belt 1 is rotated by the driving roller 2*a* in the direction indicated by an arrow mark R2 (clockwise direction). The aforementioned primary transfer roller 5, which is the primary transferring member, as the primary transferring means, is disposed on the inward side of the loop (belt loop) which the intermediary transfer belt 1 forms. Further, it is disposed so that it remains pressed against the photosensitive drum 101 by a preset amount of pressure, with the presence of the intermediary transfer belt 1 between itself and photosensitive drum 101. As it is pressed against the photosensitive drum 101, it forms the primary transfer portion N1, which is the area of contact between the intermediary transfer belt 1 and photosensitive drum 101. The belt unit 10 will be described later in greater detail.

As a toner image is formed on the peripheral surface of the photosensitive drum 101 as described above, it is transferred (primary transfer) onto the rotating intermediary transfer belt 1 by the function of the primary transfer roller 5, in the primary transferring portion N. During the primary transfer process, the primary transfer voltage (primary transfer bias) is applied to the primary transfer roller 5. During the developing process, the polarity of the primary transfer voltage is opposite (positive in this embodiment) from the polarity (normal polarity) of the toner. For example, in an image forming operation for forming a full-color image, the yellow, magenta, cyan, and black toner images formed on the photosensitive drums 101, one for one, are transferred onto the intermediary transfer belt 1 in a manner to be sequentially layered upon the intermediary transfer belt 1.

The image forming apparatus 100 is provided with a secondary transfer roller 107, as the secondary transferring means, which is in the form of a roller. The secondary transfer roller 107 is disposed on the outward side of the loop which the intermediary transfer belt 1 forms. Further, it is disposed so that it is kept pressed against the driving roller 2*a*, with the presence of the intermediary transfer belt 1 between itself and driving roller 2*a*. Thus, it forms the secondary transferring portion N2 between the intermediary transfer belt 1 and secondary transfer roller 107.

The toner image formed on the intermediary transfer belt 1 as described above is transferred (secondary transfer) onto a sheet P of transfer medium, such as recording paper, while the sheet P is conveyed between the intermediary transfer belt 1 and secondary transfer roller 107 while remaining pinched between the belt 1 and roller 107. During the secondary transferring process, the secondary transfer voltage (secondary transfer bias) is applied to the secondary transfer roller 107. The secondary transfer bias is opposite (positive in this embodiment) in polarity from the normally charged toner. The sheets P of transfer medium are stored in a cassette 108*a* or the like as a storing portion. They are sent out of the cassette 108*a* one by one by a sheet feeding apparatus 108. Then, each sheet P is conveyed to the secondary transferring portion N2 by a pair of registration rollers 108*c* so that it arrives at the secondary transferring portion N2 at the same as the toner image on the intermediary transfer belt 1.

After the transfer of a toner image onto the sheet P of transfer medium, the sheet P is conveyed to a fixing apparatus 109, as a fixing means, through which it is conveyed through the fixation nip between a fixation roller 109*a* and a pressure roller 109*b*, with which the fixing apparatus 109 is provided. While it is conveyed through the fixation nip N, the sheet P and the toner image thereon are heated and pressed. Consequently, the toner image is fixed (melted and solidly adhered) to the surface of the sheet P. Thereafter, the sheet P is discharged out of the apparatus main assembly 110 (outputted).

Meanwhile, the toner (primary transfer residual toner) remaining on the peripheral surface of photosensitive drum 101 after the primary transfer process is removed from the photosensitive drum 101 by the drum cleaning apparatus 106 as a photosensitive member cleaning means. Then, it is recovered into the casing of the drum cleaning apparatus 106.

The image forming apparatus 100 is also provided with a belt cleaning apparatus 6, as a means for cleaning the intermediary transfer belt 1. The belt cleaning apparatus 6 is disposed on the outward side of the loop which the intermediary transfer belt 1 forms, being positioned so that it opposes the tension roller 2*c*. The toner (transfer residual toner) remaining on the intermediary transfer belt 1 after the secondary transfer is removed from the intermediary transfer belt 1 by the belt cleaning apparatus 6. Then, it is recovered. The toner recovered by the belt cleaning apparatus 6 is sent to a storing apparatus (box for recovered toner) through a toner conveyance passage 120 (FIG. 6). The belt cleaning apparatus 6 will be described later in greater detail.

2. Belt Unit

Next, the belt unit 10 in this embodiment is further described. By the way, regarding the orientation of the image forming apparatus 100 and its elements, the side of elements, which correspond to the front side of the sheet of paper, on which FIG. 1 is, is referred to as the "front side," and the rear side of the sheet of paper is referred to as "back side." The depth direction, which is perpendicular to the front side and back side is roughly parallel to the directions of the axial lines of the photosensitive drum 101, and those of the rollers 2*a*, 2*b*, and 2*c*, by which the intermediary transfer belt are suspended and tensioned. The top-bottom direction means the gravity direction. However, it does not strictly mean "directly above or below" a specific point or element of the image forming apparatus 100. It includes also the top or bottom side of a horizontal plane which coincides with the specific point or element.

Figure 2:
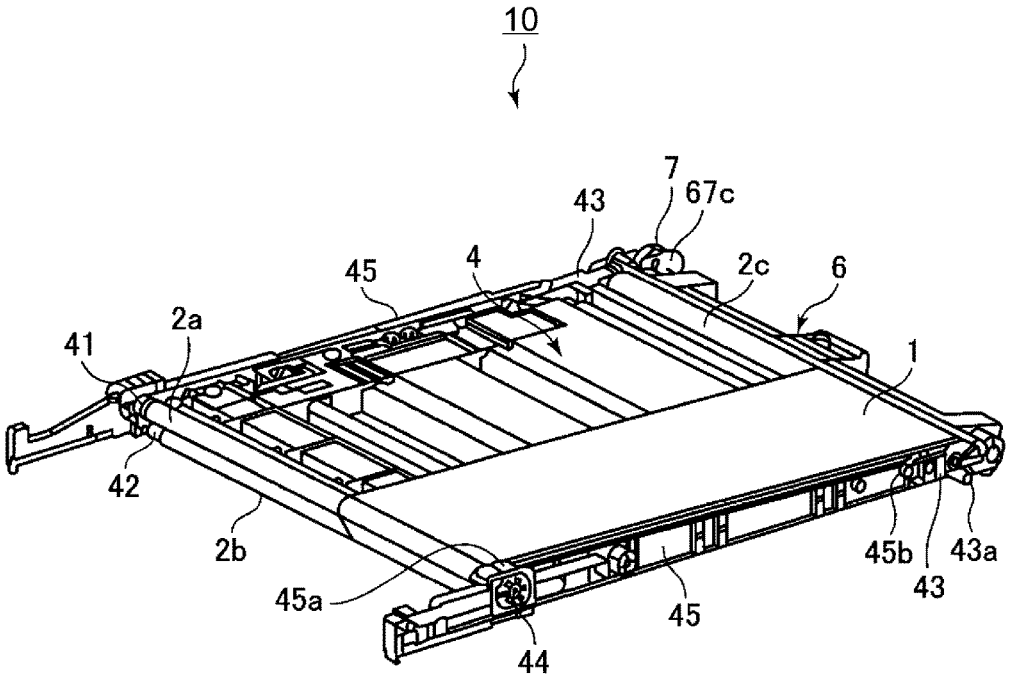
FIG. 2 is a perspective view of the intermediary transfer belt unit in the first embodiment of the present invention.

FIG. 2 is a perspective view of the belt unit 10. The image forming apparatus 100 is structured so that the belt unit 10 is installed into, or uninstalled from, the apparatus main assembly 110, by being fitted into, or removed from, a pair of rails 140 (FIG. 6), as a belt unit holding portion, with which the apparatus main assembly 110 is provided.

The belt unit 10 has the intermediary transfer belt 1 (FIG. 2 does not show part of front side of intermediary transfer belt 1). The belt unit 10 has multiple belt supporting-tensioning rollers, more specifically, the driving roller 2*a*, idler roller 2*b*, and tension roller 2*c*, by which the intermediary transfer belt 1 is suspended and tensioned. These rollers 2*a*, 2*b*, and 2*c* are attached to the frame 4 (main frame). The belt unit 10 is also provided with the primary transfer rollers 5Y, 5M, 5C, and 5K, and the structure for supporting the rollers.

The driving roller 2*a* is rotatably supported by a pair of driving roller bearing members 41 (FIG. 2 shows only the front side one), by its lengthwise end portions in terms of the direction parallel to its rotational axis. It is attached to the frame 4. It is rotated by the driving force transmitted to a driving roller coupling 44 from a driving means (unshown). As the driving roller 2*a* is rotationally driven, the intermediary transfer belt 1 is circularly moved. By the way, in order to circularly move the intermediary transfer belt 1 without slippage, the surface layer of the driving roller 2*a* is formed of such rubber that is high in coefficient of friction.

The idler roller 2*b* is rotatably supported by a pair of idler roller bearing members 42 (FIG. 2 shows only front one), by its lengthwise end portions, in terms of the direction parallel to its rotational axis. The idler roller bearing member 42 is attached to the frame 4. It is rotated by the movement of the intermediary transfer belt 1.

The tension roller 2*c* is rotatably supported by a pair of tension roller bearing members 43, by its lengthwise end portions in terms of the direction parallel to its rotational axis. The tension roller bearing members 43 are attached to the frame 4 so that they can be moved (slid) relative to the frame 4. Further, the pair of tension roller bearing members 43 are kept under the force generated by the resiliency of a pair of tension roller pressing springs (compression springs) as pressing means. That is, if the intermediary transfer belt 1 happens to slacken for some reason or another, the pair of tension roller bearing members 43 are moved outward of the belt loop (loop which intermediary transfer belt 1 forms) by these belt tension springs in the direction of the resiliency of the belt tension springs, whereby the belt tension roller 2*c* presses the intermediary transfer belt 1 outward of the belt loop from within the belt loop as indicated by an arrow mark T in FIG. 1, providing thereby the intermediary transfer belt 1 with a preset amount of tension.

By the way, the image forming apparatus 100 may be structured to allow the tension roller 2*c* to be changed in the alignment relative to one of the belt supporting-tensioning rollers (exclusive of the tension roller 2*c*) so that the tension roller 2*c* can double as a steering roller for adjusting the intermediary transfer belt 1 in position in terms of the widthwise direction of the intermediary transfer belt 1. That is, it is possible that the belt unit 10 will suffer from the so-called "belt deviation," or the phenomenon that because the belt suspending-tensioning rollers are incorrect in external diameter and/or the belt suspending-tensioning rollers are inaccurate in their alignment relative to each other, the intermediary transfer belt 1 deviates in position in the direction parallel to the rotational axes of the belt suspending-tensioning rollers. As a means for dealing with this phenomenon, or "belt deviation," it is possible to provide the lengthwise ends, in terms of the direction parallel to the axial line of the tension roller 2*c*, with a pair of frictional members (unshown), which rub the widthwise end portions of the inward surface of the intermediary transfer belt 1 as the intermediary transfer belt 1 deviates in position, so that as the intermediary transfer belt 1 deviates, one of the frictional members provides the tension roller 2*c*, which doubles as steering roller, with such force that causes the tension roller 2*c* to move in an oscillatory manner (tilt) to cause the intermediary transfer belt 1 to automatically center itself (automatically centers intermediary transfer belt 1). By the way, as the mechanism for steering the tension roller 2*c* of the belt unit 10, any of known steering mechanisms can be employed. Therefore, it is not going to be described further.

3. Belt Cleaning Apparatus

Figure 3:
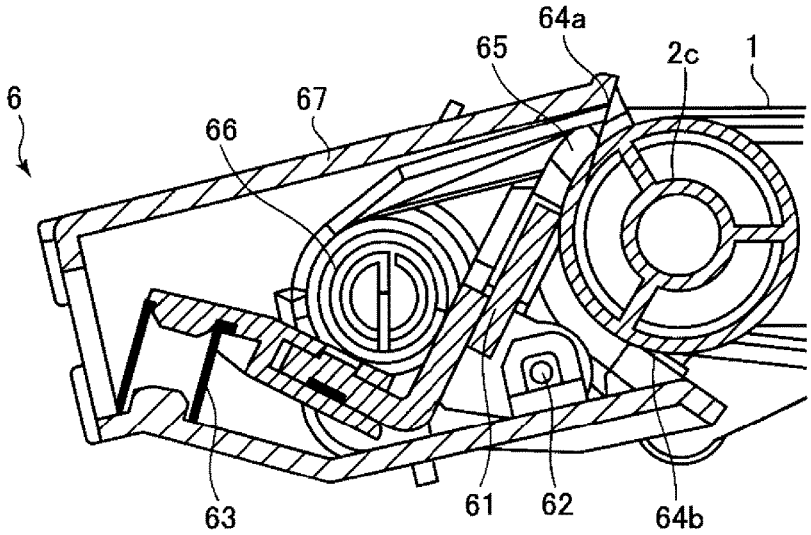
FIG. 3 is a sectional view of the belt cleaning apparatus.

Next, the belt cleaning apparatus 6 in this embodiment is described further. FIG. 3 is a sectional view of the belt cleaning apparatus 6.

The belt cleaning apparatus 6 has a cleaning blade 61 as a cleaning member. The cleaning blade 61 is disposed in contact with the outward surface of the intermediary transfer belt 1, in such an angle that the cleaning edge thereof is on the upstream side of its base portion, in terms of the moving direction of the intermediary transfer belt 1. More specifically, the cleaning blade 61 is pivotally supported by a blade supporting shaft 62, and is kept pressed toward the tension roller 2*c* by a pair of compression springs 63, with the presence of the intermediary transfer belt 1 between itself and tension roller 2*c*. The belt cleaning apparatus 6 is provided with upstream and downstream squeezing sheets 64*a* and 64*b*, which are on the upstream and downstream sides, respectively, of the cleaning blade 61, in terms of the moving direction of the intermediary transfer belt 1. Further, the belt cleaning apparatus 6 is provided with a pair of end seals 65, which are disposed at the ends of the cleaning blade 61 in terms of the lengthwise direction of the cleaning blade 61 (roughly parallel to axial line of tension roller 2*c*), in order to prevent toner from leaking out of the belt cleaning apparatus 6. Further, the belt cleaning apparatus 6 is provided with the casing 67, which functions as a container for storing the toner removed from the intermediary transfer belt 1 by the cleaning blade 61. The cleaning blade 61, blade supporting shaft 62, compression springs 63, upstream squeezing sheet 64*a*, downstream squeezing sheet 64*b*, end seals 65, and conveyance screw 66 are attached to the casing 67.

The belt cleaning apparatus 6 is attached to the frame 4. Its casing 67 is supported by a pair of rotational shafts of the tension roller 2*c*, which extend from the lengthwise ends of the tension roller 2*c*, one for one. In this embodiment, the image forming apparatus 100 and the belt cleaning apparatus 6 therefor are structured so that the belt cleaning apparatus 6 can be installed into, or uninstalled from, the apparatus main assembly 110, together with the intermediary transfer belt 1 which is suspended and tensioned by multiple belt supporting-tensioning rollers. That is, they are structured so that the belt cleaning apparatus 6 can be installed into, or uninstalled from, the apparatus main assembly 110, as a part of the belt unit 10.

The belt cleaning apparatus 6 scrapes toner away from the outward surface of the intermediary transfer belt 1, by its cleaning blade 61, and recovers the removed toner into its casing 67. As the toner is recovered into the casing 67, it is conveyed frontward by the conveyance screw 66, in the lengthwise direction of the belt cleaning apparatus 6 (roughly parallel to rotational axis of tension roller 2*c*). Then, it is conveyed out of the belt cleaning apparatus 6.

Figure 4:
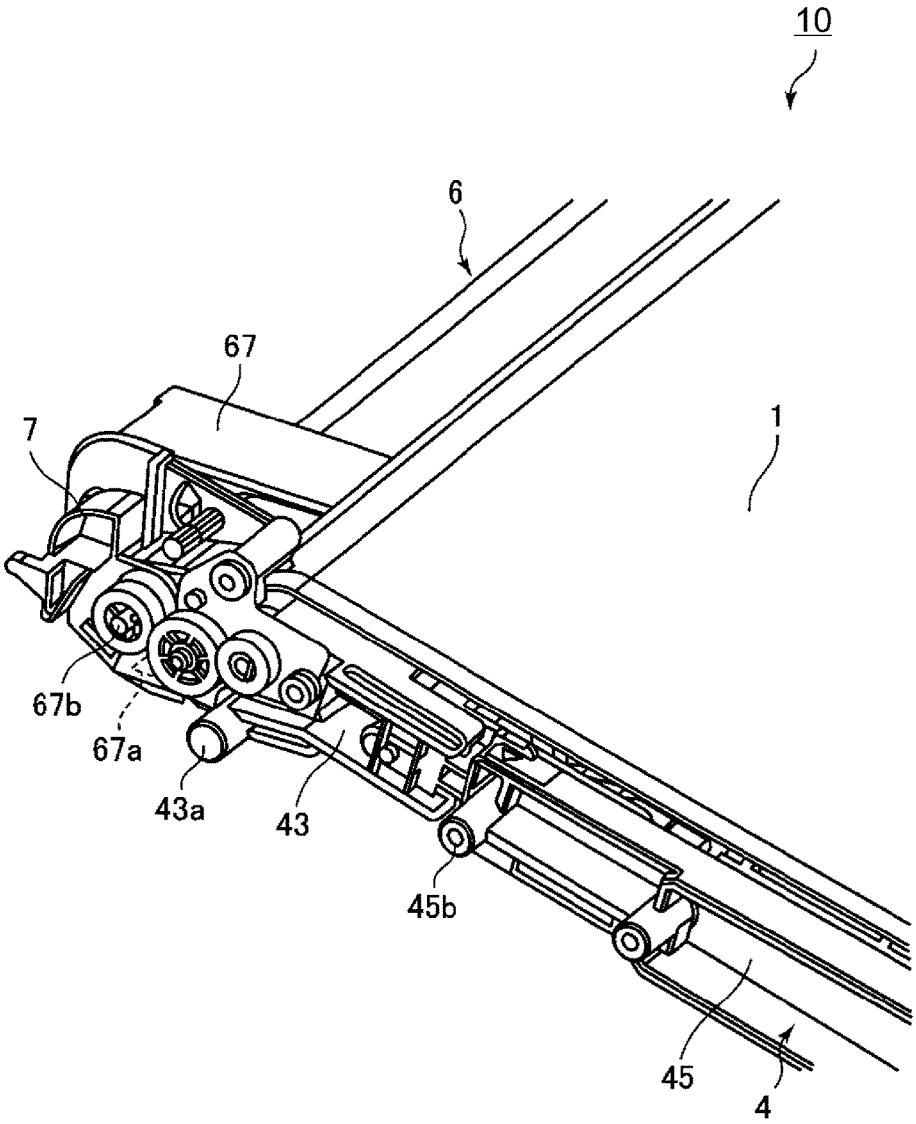
FIG. 4 is a perspective view of the shutter and its adjacencies.

FIG. 4 is a perspective view of the front end portion of the belt cleaning apparatus 6, in terms of the lengthwise direction of the belt cleaning apparatus 6. The casing 67 of the belt cleaning apparatus 6 is provided with an opening 67*a* for allowing the toner in the casing 67 to be discharged from the casing 67. The toner discharge opening 67*a* is a part of the front end portion of the bottom wall of the casing 67, in terms of the lengthwise direction of the casing 67 (roughly parallel to rotational axis of tension roller 2*c*). When the belt unit 10 is in its normal installation completion position in the apparatus main assembly 110, the toner discharge opening 67*a* is in connection to the toner conveyance passage 120 (FIG. 6), with which the apparatus main assembly 110 is provided, as will be described later in detail. As the toner is conveyed by the conveyance screw 66, it is discharged out of the casing 67 through the toner discharge opening 67*a*. Then, as the toner is discharged through the opening 67*a*, it is sent to a storing apparatus 130 (FIG. 6), with which the apparatus main assembly 110 is provided, through the toner conveyance passage 120.

The belt cleaning apparatus 6 has a shutter 7 attached to the front end of the belt cleaning apparatus 6 to unblock or block the toner discharge opening 67. The shutter 7 is rotationally movable between its open position, in which it does not block the toner discharge opening 67*a*, and its closed position, in which it blocks the toner discharge opening 67*a*. In this embodiment, the shutter 7 rotationally moves between its open position and closed position. As the belt cleaning apparatus 6 is pulled out of the apparatus main assembly 110, as a part of the belt unit 10, the toner discharge opening 67*a* is closed (blocked) by the shutter 7, in order to prevent the toner in the belt cleaning apparatus 6 from scattering out of the belt cleaning apparatus 6.

Part (a) of FIG. 5 is a perspective view of the shutter 7 as seen from the back side of the shutter 7. The shutter 7 is made up of a shutter shaft hole 71, a blocking portion 72, an opening 73, a spring anchoring shaft 74, and so on. To the spring anchoring shaft 74, a shutter spring 8, which is a torsional coil spring, is attached to by one of its lengthwise end portions 81. This shutter spring 8 also is a part of the belt cleaning apparatus 6.

Part (b) of FIG. 5 is a sectional view of the shutter 7, as seen from the back side of the shutter 7, when the shutter 7 is in its closed position. That is, when the shutter 7 is in the position shown in part (b) of FIG. 5, the toner discharge opening 67*a* remains closed by the blocking portion 72 of the shutter 7. The shutter 7 is rotatably supported by the shutter shaft 67*b* (FIG. 4), with which the casing 67 is provided, and which is inserted through the shutter shaft hole 71 of the shutter 7. The shutter shaft 67*b* protrudes frontward from the front side of the casing 67, roughly in parallel to the lengthwise direction of the casing 67. Thus, the shutter 7 is rotatable about its rotational axis which is roughly parallel to the lengthwise direction of the belt cleaning apparatus 6. The other end portion 82 of the shutter spring 8 is attached to the casing 67. It is inserted into the spring hole 67*c* (FIG. 2) with which the casing 67 is provided. The straight line (dotted line in FIG. 5) which connects the center (rotational axis of shutter 7) of the shutter shaft hole 71 and the axial line of the shutter shaft 67*b*, as seen from the direction parallel to the axial line, is referred to as a straight line Ls. When the belt cleaning apparatus 6 is in such a state that the spring anchoring shaft 74 is on the top side of the straight line Ls, the shutter 7 is under the pressure generated by the resiliency of the shutter spring 8, and remains, therefore, pressed in the direction (closing direction) indicated by an arrow mark Rc in the drawing.

Part (c) of FIG. 5 is a sectional view of the shutter 7, as seen from the back side of the shutter 7, when the shutter 7 is in its open position. That is, when the shutter 7 is in the position shown in part (c) of FIG. 5, the toner discharge opening 67*a* is exposed (open). The opening 73 of the shutter 7 remains aligned with the toner discharge opening 67*a*. As the spring anchoring shaft 74 is pressed downward of the drawing while the shutter 7 is in its closed position shown in part (b) of FIG. 5, the spring anchoring shaft 74 moves in a manner to step across the straight line Ls described above. As the spring anchoring shaft 74 steps across the straight line Ls as shown in part (c) of FIG. 5, the shutter 7 comes under the force generated by the shutter spring 8, and is held in such a state that it remains pressed by the force generated by the shutter spring 8 in the direction indicated by an arrow mark Ro (opening direction) in the drawing.

As described above, in this embodiment, the belt cleaning apparatus 6 has a holding means which is capable of holding the shutter 7 in the open position or closed position even when the belt cleaning apparatus 6 is not in the apparatus main assembly 110. In this embodiment, this holding means has the shutter spring 8 as a pressing means. As the shutter 7 is moved toward the closed position beyond a preset position in the shutter movement range, the shutter spring 8 presses the shutter 7 toward the open position. On the other hand, as the shutter 7 is moved toward the closed position beyond the aforementioned preset position, the shutter spring 8 presses the shutter 7 toward the closed position. That is, in this embodiment, the shutter 7 is enabled to behave like a toggle switch.

Since the belt cleaning apparatus 6 is structured so that the shutter 7 is enabled to function like a toggle switch, the pressure required to open the shutter 7 is contained in the belt cleaning apparatus 6. That is, unlike a case in which the belt cleaning apparatus 6 is structured so that the shutter 7 remains pressed only in the direction to keep the toner discharge opening 67*a* blocked, it does not occur that after the installation of the apparatus main assembly 110, the tension roller 2*c* and frame 4 always remains under the pressure generated to press the shutter 7. Therefore, it does not occur that the pressure for keeping the toner discharge opening 67*a* closed affects the tension of the intermediary transfer belt 1 as described above, and/or the steering operation of the tension roller 2*c* when the tension roller 2*c* doubles as a steering roller. Therefore, it becomes possible for the intermediary transfer belt 1 to be stable in its movement.

In this embodiment, ordinarily, when the belt unit 10 is inserted into the apparatus main assembly 110, the shutter 7 is in the closed position. Then, as the belt unit 10 begins to be inserted, the shutter 7 begins to be moved into the open position, as will be described later in detail. However, if the shutter 7 happens to be in the closed position for some reason or another, it sometimes becomes impossible to insert the belt unit 10 into the normal installation completion position in the apparatus main assembly 110, because it sometimes occurs that while the belt unit 10 is inserted toward the installation completion position, the portion of the belt unit 10, which is for opening or closing the shutter 7, interferes with the insertion of the belt unit 10. If the belt unit 10 fails to be inserted into the normal insertion completion position, the belt cleaning apparatus 6 sometimes fails to be correctly connected to the toner conveyance passage 120, allowing the recovered toner in the belt cleaning apparatus 6 to scatter out of the belt cleaning apparatus 6, providing the intermediary transfer belt 1 with an improper amount of tension, and/or causing the tension roller 2*c* to improperly steer the intermediary transfer belt 1.

4. Insertion or Pullout of Belt Unit, and Shutter Movement

Next, referring to FIGS. 6-9, the relationship between the insertion of belt unit 10 into the apparatus main assembly 110, and the shutter movement (opening or closing), is described.

FIG. 6 is a perspective view of a combination of the belt unit 10, toner conveyance passage 120, and storing apparatus 130, after the insertion of the belt unit 10 into its normal installation completion position in the apparatus main assembly 110. The belt unit 10 is provided with a pair of rails 40 (front one is not shown), as belt unit accommodating (guiding) portions, which are located at the front and rear ends, one for one, of the apparatus main assembly 110. Each rail 140 is provided with a guiding portion (unshown) for guiding a frame positioning portion 45*a* and a frame positioning boss 45*b*, with which each of the lateral supporting members is provided. The rail 140 is also provided with a guiding portion (unshown) for guiding the cleaning apparatus positioning boss 43*a* (FIG. 2), with which each of the tension roller bearing members 43 is provided. The belt unit 10 is inserted into the apparatus main assembly 110 in the direction indicated by an arrow mark W, toward the installation completion position, in such a manner that the belt cleaning apparatus 6 leads the insertion. Then, in synchronism with the arrival of the belt unit 10 into the normal installation completion position, the shutter 7 is moved into its closed position, and the belt cleaning apparatus 6 becomes connected to the toner conveyance passage 120.

Parts (a) and (b) of FIG. 7 are sectional views of a combination of the belt unit 10, rail 140, and their adjacencies, as seen from the front side of the combination, while the belt unit 10 is inserted into the apparatus main assembly 110, and show the shutter movement which occurs during the insertion of the belt unit 10.

The rail 140 has a shutter moving portion 141 which opens or closes the shutter 7 by being aided by the belt unit 10 as the belt unit 10 is fitted into, or pulled out of, the rail 140. As the belt unit 10 is inserted into the rail 140, the shutter 7 comes into contact with the shutter moving portion 141. Then, as the belt unit 10 is inserted further, the shutter 7 is moved from its closed position to its open position by the movement of the belt unit 10. On the other hand, as the belt unit 10 is moved outward along the rail 140 to be uninstalled, the shutter 7 comes into contact with the shutter moving (opening or closing) portion 141. Then, as the belt unit 10 is moved further outward, the shutter 7 is moved from its open position to the closed position by the outward movement of the belt unit 10. In this embodiment, the shutter moving portion 141 has a shutter opening portion 141*a* which causes the shutter 7 to move from the closed position to the open position, by being contacted by the shutter 7 while the belt unit 10 is inserted into the apparatus main assembly 110. Further, the shutter moving portion 141 has a shutter closing portion 141*b*, which causes the shutter 7 to move from the open position to the closed position by being contacted by the shutter 7 while the belt unit 10 is pulled out of the rail 140. The shutter moving portion 141 is disposed in the path of the belt unit 10. It is positioned closer to the installation completion position than the center of the belt unit path. More concretely, it is disposed next to the installation completion position. In this embodiment, the shutter 7 has: the first contacting portion 75*a*, which comes into contact with the aforementioned shutter opening portion 141*a*; and the second contacting portion 75*b* which comes into contact with the aforementioned shutter closing portion 141*b*.

That is, as the belt unit 10 is inserted into the apparatus main assembly 110, while being guided by the rails 10, toward the installation completion position, that is, in the direction indicated by an arrow mark W in the drawing, the first contacting portion 75*a* of the shutter 7 comes into contact with the shutter opening portion 141*a* as shown in part (a) of FIG. 7. The force which the first contacting portion 75*a* of the shutter 7 receives from the shutter opening portion 141*a* at this point in time is directed as indicated by an arrow mark F1, which is perpendicular to the shutter opening portion 141*a*. Thus, if the force applies to the side A in the drawing, with reference to a straight line L1 which coincides with the center of the rotational movement of the shutter 7 and the point of contact between the first contacting portion 75*a* shutter opening portion 141*a*, such moment that causes the shutter 7 to rotate about its rotational center 71*a* in the direction to open occurs. On the other hand, if the force applies to the side B in the drawing, such moment that causes the shutter 7 to rotate in the direction to close occurs. The belt cleaning apparatus 6 is structured so that the force F1 generated by the belt unit insertion applies on the side A in the drawing. Therefore, such a moment M1 that causes the shutter 7 to rotate in the opening direction is generated in the shutter 7. Therefore, the shutter 7 is rotationally moved to the open position as shown in part (b) of FIG. 7. When the shutter 7 is in the state shown in part (b) of FIG. 7, the belt cleaning apparatus 6 is correctly in connection to the toner conveyance passage 120 (FIG. 6). After the belt unit 10 moves into the installation completion position, the shutter 7 is no longer in contact with the shutter moving portion 141. However, the shutter 7 is held in the closed position.

Parts (a) and (b) of FIG. 8 are sectional views of the combination of the belt cleaning apparatus 6 and the rail 140, as seen from the front side, and are for describing the movement of the shutter 7, which occurs while the belt unit 10 is pulled out of the apparatus main assembly 110.

As the belt unit 10 is moved out of the installation completion position in the direction indicated by an arrow mark X in the drawing while being guided by the rails 140, the second contacting portion 75*b* of the shutter 7 comes into contact with the shutter closing portion 141*b* of the rail 140, as shown in part (a) of FIG. 8. At this point, the force which the shutter 7 receives from the shutter closing portion 141*b* at the second contacting portion 75*b* has the direction indicated by an arrow mark F2 in the drawing, which is perpendicular to the shutter closing portion 141*b*. Thus, the force applies to the side A, with reference to a straight line L2 which coincides with the rotational center of the shutter 7, and, at the point of contact between the second contacting portion 75*b*, such a moment that causes the shutter 7 to rotationally move about its rotational center 71*a* is generated in the shutter 7. On the other hand, if the force applies to the side B in the drawing, such a moment that causes the shutter 7 to close is generated in the shutter 7. In this embodiment, the belt cleaning apparatus 6 is structured so that the generated force F2 applies to the side B with reference to the straight line L2. Therefore, a moment M2 that causes the shutter 7 to rotate in the closing direction is generated in the shutter 7. Therefore, the shutter 7 is moved into the closed position as shown in part (b) of FIG. 8. Thus, even after the belt unit 10 is completely pulled out of the apparatus main assembly 110, the shutter 7 is held in the closed position.

Parts (a) and (b) of FIG. 9 are sectional views of the combination of the belt unit 10 and rail 140, as seen from the front side, when the shutter 7 is in the open position, and show the movement of the shutter 7, which occurs if the belt unit 10 is inserted into the apparatus main assembly 110 while the shutter 7 is already in the open position for some reason or another.

The rail 140 has a shutter closing portion 142, which causes the movement of the belt unit 10 to close the shutter 7 if the belt unit 10 is inserted into the apparatus main assembly 110 while the shutter 7 is in the open position. In terms of the direction in which the belt unit 10 is fitted into the rails 140, the shutter 7 comes into contact with the shutter closing portion 142 on the upstream side of the shutter moving portion 141, whereby it is moved from the open position to the closed position. In this embodiment, the shutter closing portion 142 is positioned closer to the installation completion position, in the path of the belt unit 10, than the center of the path, more specifically, in the upstream adjacencies of the shutter opening portion 141*a*. Moreover, in this embodiment, the shutter 7 is provided with the third contacting portion 75*c*, which comes into contact with the shutter closing portion 142 described above.

That is, as the belt unit 10 is inserted into the apparatus main assembly 110, toward the installation completion position, while being guided by the rails 140, in the direction indicated by the arrow mark W in the drawing, the third contacting portion 75*c* of the shutter 7 comes into contact with the shutter closing portion 142 of the rail 140 as shown in part (a) of FIG. 9. At this point in time, the force which the third contacting portion 75*c* of the shutter 7 receives from the shutter closing portion 142 has the direction indicated by an arrow mark F in the drawing, which is perpendicular to the shutter closing portion 142. Thus, if the force is applied to the side A in the drawing, with reference to the straight line L3 which coincides with the rotational center of the shutter 7, at the point of contact between the third contacting portion 75*c* and shutter closing portion 142, such a moment that causes the shutter 7 to rotate about its rotational center 71 in the direction to open is generated in the shutter 7. On the other hand, if the force applies to the side B in the drawing, such a moment that causes the shutter 7 to rotate in the direction to close is generated in the shutter 7. In this embodiment, the image forming apparatus 100 is structured so that the force F3 applies to the side B with reference to the straight line L3. Therefore, such a moment M2 that causes the shutter 7 to rotate in the closing direction is generated in the shutter 7. Thus, the shutter 7 is rotationally moved to the closed position as shown in part (b) of FIG. 9. As described above, in this embodiment, if the belt unit 10 is inserted into the apparatus main assembly 110 while the shutter 7 is in the open position for some reason or another, the shutter 7 is temporarily closed by the shutter closing portion 142. Then, as the belt unit 10 is inserted further toward the installation completion position in the direction indicated by the arrow mark W, the shutter 7 is moved to the open position in the same manner as it is moved in the normal installation process, as described with reference to part (b) of FIG. 7. Consequently, the belt cleaning apparatus 6 is correctly connected to the toner conveyance passage 120 (FIG. 6).

By the way, if the belt unit 10 is not provided with the shutter closing portion 142, the following occurs as the belt unit 10 is inserted into the apparatus main assembly 110 while the shutter 7 is in the open position. That is, it sometimes occurs that the shutter closing portion 141*b* of the rail 140, which the shutter 7 is not to come into contact, becomes a barrier, and therefore, the belt unit 10 cannot be inserted into the normal installation completion position, making it impossible for the belt cleaning apparatus 6 to be correctly connected to the toner conveyance passage 120.

In comparison, in this embodiment, the shutter closing portion 142 is disposed in the path through which the belt unit 10 is inserted toward the installation completion position, more specifically, on the upstream side of the shutter moving portion 141, in terms of the direction in which the belt unit 10 is fitted into the rails 140. Thus, even if the belt unit 10 is inserted into the apparatus main assembly 110 while the shutter 7 is in the open position, the shutter 7 is closed before the belt unit 10 reaches the shutter moving portion 141. Then, the shutter 7 is opened in the preset position, allowing the belt unit 10 to be inserted into the normal installation completion position, as it is when the shutter 7 is in the normal position (closed position). Therefore, the belt cleaning apparatus 6 and toner conveyance passage 120 become connected to each other as they are when the shutter 7 is in the normal position.

As described above, according to this embodiment, even if the belt unit 10 is inserted into the apparatus main assembly 110 while the shutter 7 is in the open position, the belt unit 10 can be inserted into the installation completion position. Therefore, the belt cleaning apparatus 6 and toner conveyance passage 120 are correctly connected to each other. That is, according to this embodiment, not only is it possible to prevent the force for pressing the shutter 7 from affecting the movement of the intermediary transfer belt 1, but also, it is possible to prevent the problem which would have occurred if the belt unit 10 is inserted into the apparatus main assembly 110 while the shutter 7 is in the open position.

Embodiment 2

Next, another embodiment of the present invention is described. The image forming apparatus in this embodiment is the same in basic structure and operation as the one in the first embodiment. Therefore, the elements of the image forming apparatus in this embodiment, which are the same as, or correspondent to, the counterparts in the first embodiment, in function or structure, are given the same referential codes as those given to the counterparts, and are not described in detail.

In the first embodiment, as the shutter 7 is rotated upward (direction indicated by arrow mark Rc in part (b) of FIG. 5) while it is in the open position, it blocked the toner discharge opening, whereas as the shutter 7 is rotated downward (indicated by arrow mark Ro in part (c) of FIG. 5), it unblocked the toner discharge opening. In comparison, this embodiment is opposite to the first embodiment, in the relationship between the rotational direction of the shutter 7, and the blocking and unblocking of the toner discharge opening.

FIG. 10 is a perspective view of the shutter 7 in this embodiment as seen from the back side of the shutter 7. Referring to FIG. 10, the shutter 7 in this embodiment is opposite to the shutter 7 in the first embodiment, in the positional relationship between the blocking portion 72 and unblocking portion 73, in terms of the rotational direction of the shutter 7. In this embodiment, therefore, the shutter 7 unblocks the toner discharge opening by being rotationally moved downward (direction indicated by arrow mark Rc in FIG. 10), and blocks the toner discharge opening by being rotationally moved upward (direction indicated by arrow mark Ro).

Parts (a) and (b) of FIG. 11 are sectional views of the combination of the belt cleaning apparatus 6 and rail 140, as seen from the front side, and show the movement of the shutter 7, which occurs as the belt unit 10 in this embodiment is inserted into the apparatus main assembly 110. Also in this embodiment, each rail 140 is provided with the shutter opening portion 141*a* and shutter closing portion 141*b*, as in the first embodiment. The shutter 7 is provided with the first and second contacting portions 75*a* and 75*b* as it is in the first embodiment. In this embodiment, however, the positioning of these first and second contacting portions has been changed, because of the change in the positional relationship between the blocking portion 72 and unblocking portion 73.

That is, in this embodiment, as the belt unit 10 is insert into the apparatus main assembly 110, toward the installation completion position, that is, in the direction indicated by the arrow mark W, while being guided by the rails 140, the first contacting portion 75*a* of the shutter 7 comes into contact with the shutter opening portion 141*a* of the rail 140 as shown in part (a) of FIG. 11. Then, as the belt unit 10 is inserted deeper into the apparatus main assembly 110, the shutter 7 is pressed in the direction indicated by an arrow mark F4 in the drawing. Thus, a moment M1 which causes the shutter 7 to rotationally move about its rotational center 71*a* is generated in the shutter 7. Therefore, the shutter 7 is moved into the open position by this moment M1 as shown in part (b) of FIG. 11. When the shutter 7 is in this state, the belt cleaning apparatus 6 and the toner conveyance passage 120 (FIG. 6) are correctly connected to each other.

Parts (a) and (b) of FIG. 12 are sectional views of the combination of the belt cleaning apparatus 6 and rail 140 in this embodiment, as seen from the front side, and show the movement of the shutter 7 which occurs while the belt unit 10 is pulled out of the apparatus main assembly 110.

As the belt unit 10 is moved outward of the apparatus main assembly 110, from the installation completion position, in the direction indicated by an arrow mark X while being guided by the rails 140, the second contacting portion 75*b* of the shutter 7 comes into contact with the shutter closing portion 141*b* of the rail 140, as shown in part (a) of FIG. 12. Then, as the belt unit 10 is moved further outward, the shutter 7 is pressed in the direction indicated by an arrow mark F5. Thus, a moment M2 which causes the shutter 7 to rotate about its rotational center 71*a* in the shutting direction is generated in the shutter 7. Consequently, the shutter 7 is moved into the closed position, as shown in part (b) of FIG. 12.

Parts (a) and (b) of FIG. 13 are sectional views of the combination of the belt unit 10 and rail 140, as seen from the front side, and show the movement of the shutter 7, which occurs if the belt unit 10 is inserted into the apparatus main assembly 110 while the shutter 7 is in the open position for some reason or another. Also in this embodiment, the rail 140 is provided with shutter closing portion 142, and the shutter 7 is provided with the third contacting portion 75*c*, as in the first embodiment. In this embodiment, however, the shutter closing portion 142 and third contacting portion 75*c* have been changed in position, because of the change in the positioning of the blocking portion 72 and unblocking portion 73 described above.

Therefore, as the belt unit 10 is inserted into the apparatus main assembly 110, toward the installation completion position, that is, in the direction indicated by the arrow mark W, while being guided by the rails 140, the third contacting portion 75*c* of the shutter 7 comes into contact with the shutter closing portion 142 of the rail 140, as shown in part (a) of FIG. 13. Then, as the belt unit 10 is inserted further into the apparatus main assembly 110, the shutter 7 is pressed in the direction indicated by an arrow mark F6. Thus, a moment M2 which causes the shutter 7 to rotate about its rotational center 71*a* in the closing direction is generated. Consequently, the shutter 7 is moved to the closed position, as shown in part (b) of FIG. 13. Then, as the belt unit 10 is inserted further into the apparatus main assembly 110 toward the installation completion position as indicated by the arrow mark W in the drawing, the shutter 7 is moved to the open position, through the steps described with reference to FIG. 11, as it is when it is in the normal position (closed position). Thus, the belt cleaning apparatus 6 and toner conveyance passage 120 (FIG. 6) are correctly connected to each other.

As described above, also in this embodiment which is opposite to the first embodiment, in the relationship between the rotational direction of the shutter 7, and the state (open or closed) of the shutter 7, the same effects as those obtained in the first embodiment can be obtained.

Embodiment 3

Next, another embodiment of the present invention is described. The image forming apparatus in this embodiment is the same in basic structure and operation as the one in the first embodiment. Therefore, the elements of the image forming apparatus in this embodiment, which are the same as, or correspondent to, the counterparts in the first embodiment, in function or structure, are given the same referential codes as those given to the counterparts, and are not described in detail.

1. Shutter

FIG. 14 is a perspective view of the front end portion of the belt cleaning apparatus 6 in this embodiment, in terms of the lengthwise direction of the apparatus 6. Part (a) of FIG. 15 is a perspective view of the shutter 7 in this embodiment as seen from its back side. The shutter 7 in this embodiment has roughly the same structure as the shutter 7 in the first embodiment. That is, the shutter 7 is made up of the supporting hole 71, blocking portion 71, opening 73, spring anchoring shaft 74, and so on. One end portion 81, of the end portions of the shutter spring 8 (which is coil spring), is attached to the spring anchoring shaft 74.

Part (b) of FIG. 15 is a sectional view of the shutter 7, as seen from the back side of the shutter 7, when the shutter 7 is in the closed position. A shutter shaft 67*b*, with which the casing 67 of the belt cleaning apparatus 6 is provided, is inserted into the shutter shaft hole 71, whereby the shutter 7 is rotatably supported by the casing 67. The other end 82 of the shutter spring 8 is inserted into the spring hole 67*c*, with which the casing 67 is provided, whereby the shutter spring 8 is held to the casing 67. When the spring anchoring shaft 74 is on the top side of the straight line Ls (dotted line in drawing) which coincides with the rotational center 71*a* and spring hole 67*c*, the shutter 7 is under the force generated by the resiliency of the shutter spring 8. Thus, the shutter 7 is held in such a state that it remains continuously pressed in the direction (opening direction) indicated by an arrow mark Ro in the drawing.

Part (c) of FIG. 15 is a sectional view of the shutter 7, as seen from the back side of the shutter 7, when the shutter 7 is in the open position. As the shutter 7 is pressed downward when it is in the closed position shown in part (b) of FIG. 15, the spring anchoring shaft 74 moves in a manner to step over the straight line Ls described above. Then, as the spring anchoring shaft 74 steps over the straight line Ls as shown in part (c) of FIG. 15, the shutter 7 comes under the force generated by the shutter spring 8, whereby the shutter 7 is held in such a state that it remains pressed in the direction (opening direction) indicated by an arrow mark Ro in the drawing.

As described above, the shutter 7 in this embodiment is also of the so-called toggle type like the one in the first embodiment. However, the shutter 7 in this embodiment is different from the one in the first embodiment in that it is provided with a shutter guiding shaft 76 which is used to open or close the shutter 7 as will be described later.

2. Portion to be Guided, and Guiding Portion

Part (a) of FIG. 16 is a perspective view of the front rail 140 in the embodiment. The rail 140 has a frame guiding groove 143 which guides a frame positioning portion 45*a* and frame positioning boss 45*b*, with which the frame 4 is provided. In terms of the lengthwise direction of a side portion supporting member 45, the frame positioning 45*a* is on the drive roller side of the center of the side portion supporting member 45. The frame positioning boss 45*b* is on the tension roller side of the center portion of the side portion supporting member 45. Further, the rail 140 has a guiding groove 144 which guides the positioning boss 43*a*, with which the tension roller bearing member 43 is provided. Moreover, the rail 140 is provided with a catching portion 146 which positions the frame positioning portion 45*a*. Further, the frame guiding groove 13 is provided with a frame positioning portion 143*a* which positions the frame positioning boss 43*a*. By the way, the rear rail 140 (unshown) also is provided with the frame guiding groove 143 and cleaning guiding groove 144. The image forming apparatus 100 is structured so that the rear rail 140 is symmetrical in position with the front rail 140 with reference to the substantive center line of the intermediary transfer belt 1 in terms of the widthwise direction of the belt 1. As described above, the belt unit 10 has: the frame positioning portion 45*a*, which is the first portion to be guided, with which a portion other than the shutter 7 is provided; frame positioning boss 45*b*; and the cleaning positioning boss 43*a*. Moreover, the rail 140 has the frame guiding groove 143 and cleaning guiding groove 144, which are the first guiding portions which guide the abovementioned first portions 45*a*, 45*b*, and 43*a* to be guided when the belt unit 10 is fitted into, or moved out of, the rails 140.

As for the shutter 7, it is provided with a shutter guiding shaft 76 (shown in FIG. 14 and parts (a) to (c) of FIG. 15), which is protrusive frontward from the shutter 7 roughly in parallel to the lengthwise direction of the belt cleaning apparatus 6 (direction parallel to rotational axis of tension roller 2*c*). Further, the rail 140 has a shutter guiding groove 145 which guides the shutter guiding shaft 76. As described above, the belt unit 10 has the shutter guiding shaft 76*a*, as the second portion, by which the shutter 7 is guided. Further, the rail 140 has the shutter guiding groove 145, as the second guiding portion, which guides the portion 76 to be guided, when the belt unit 10 is fitted into, or pulled out of, the rails 140.

The shutter guiding groove 145 has the first area (which is referred to as area 1), a second area (which hereafter may be referred to as area 2), and a third area (which hereafter is referred to as area 3), listing from the upstream side in terms of the direction in which the belt unit 10 is fitted into, or pulled out of, the rails 140. The area 1 is such an area that the belt unit 10 can move through regardless of whether the shutter 7 is in the open or closed position. The area 2 is such an area that as the belt unit 10 is moved through the area when the belt unit 10 is fitted into the rails 140, the shutter 7 is moved from the open position to the closed position. The area 3 is such an area that as the belt unit 10 is moved through the area in the direction in which the belt unit 10 is pulled out of the rails 10, the shutter 7 is moved from the open position to the closed position. In this embodiment, the area 2 of the shutter guiding groove 145 makes up a shutter closing portion having the same function as the counterpart in the first embodiment. The area 3 of the shutter guiding groove 145 makes up a shutter opening-closing portion having the same function as the shutter moving portion 141 in the first embodiment. Also in this embodiment, the area 2 of the shutter guiding groove 145, which makes up a shutter closing portion, is disposed closer to the entrance of the rail 140, through which the belt unit 10 is fitted into the rails 140, than the center of the portion of the 140, through which belt unit 10 is moved. Also in this embodiment, the area 3 of the shutter guiding groove 145, which makes up a shutter moving portion, is on the installation completion position side, more concretely, immediately before the installation completion position, relative to the center of the portion of the rail 140, through which the belt unit 10 moves.

In this embodiment, the area 2 of the shutter guiding groove 145 is provided with a slanted surface 145*a* (guiding surface), as a shutter closing portion, with which the shutter guiding shaft 76 of the shutter 7 comes into contact as the belt cleaning apparatus 6 is inserted into the apparatus main assembly 110, and by which the shutter 7 is moved from the open position to the closed position. In this embodiment, the shutter 7 moves from the open position to the closed position by being rotated upward as shown in part (b) of FIG. 15. Therefore, the slanted surface 145*a* is tilted in such an angle that its upstream side of the slanted surface 14*a*, in terms of the direction in which the belt cleaning apparatus 6 is inserted, is positioned lower than the downstream side. That is, the slanted surface 145*a* is tilted in such an angle that as the belt unit 10 is moved from the upstream side to the downstream side, it causes the shutter guiding shaft 76 to move upward.

Further, the area 3 of the shutter guiding groove 145 is provided with a top tilted surface 145*b* (guiding surface), as a shutter opening portion, which causes the shutter 7 to move from the closed position to the open position, as the shutter guiding shaft 76 of the shutter 7 comes into contact with it while the belt unit 10 is fitted into the area 3 of the shutter guiding groove 145. In this embodiment, the image forming apparatus 100 is structured so that the shutter 7 is moved from the closed position to the open position by being downwardly rotated, as shown in part (c) of FIG. 15. Therefore, the top tilted surface 145*b* is tilted so that as the belt unit 10 is moved from the upstream side to the downstream side in terms of the belt unit insertion direction, the top tilted surface 145*b* moves the shutter guiding shaft 76 downward. That is, the top slanted surface 145*b* is tilted so that, in terms of the belt unit insertion direction, its upstream side is higher in position than its downstream side.

Moreover, the area 3 of the shutter guiding groove 145 is provided with a bottom slanted surface 145*c*, as a shutter closing portion, with which the shutter guiding shaft 76 of the shutter 7 comes into contact while the belt unit 10 is pulled out of the apparatus main assembly 110, whereby the shutter 7 is moved from the open position to the closed position. In this embodiment, the image forming apparatus 100 is structured so that the shutter 7 is moved from the open position to the closed position by being upwardly rotated, as shown in part (b) of FIG. 15. Therefore, the bottom slanted surface 145*c* is tilted so that as the belt unit 10 is moved from the upstream side to the downstream side in terms of the belt unit pullout direction, the bottom slanted surface 145*c* causes the shutter guiding shaft 76 to upwardly move. That is, the bottom slanted surface 145*c* is tilted so that, in terms of the belt unit pullout direction, its upstream side is lower in position than its downstream side.

In this embodiment, by the way, the shutter guiding groove 145 is structured so that its top and bottom slanted surfaces 145*b* and 145*c*, respectively, are roughly parallel to each other, and also, so that the distance between the top and bottom slanted surfaces 145*b* and 145*c* is greater than the diameter of the shutter guiding shaft 76 which is roughly in the shape of a piece of round rod.

Part (b) of FIG. 16 is a sectional view of the combination of the rail 140 and belt unit 10, as seen from the back side of the combination, after the belt unit 10 has been properly positioned relative to the rail 140. As the frame positioning portion 45*a* comes into contact with the catching portion 146, the frame 4 becomes properly positioned in terms of the top-bottom direction as well as the left-right direction (which is the same as widthwise direction of intermediary transfer belt 1). Further, as the frame positioning boss 45*b* fits into the frame positioning portion 143*a*, the frame 4 is prevented from rotating. Further, as the cleaning positioning boss 43*a* fits into the cleaning positioning portion 144*a*, the belt cleaning apparatus 6 becomes properly positioned in terms of the top-bottom direction. The cleaning positioning boss 43*a* is an integral portion of the tension roller bearing members 43. Therefore, the tension roller 2*c* also is properly positioned at this time.

3. Belt Unit Pullout and Shutter Movement

Next, referring to part (a) of FIG. 17 to FIG. 21, the process of pulling the belt unit 10 in this embodiment, out of the apparatus main assembly 110, and the shutter movement caused by the process, are described. Part (a) of FIG. 17 to FIG. 21 are sectional views of a combination of the rail 140 and belt unit 10, as seen from the front side of the combination. They sequentially show the movements of the shutter 7, which occur while the belt unit 10 is inserted into the apparatus main assembly 110.

Parts (a) and (b) of FIG. 17 are sectional views of a combination of the shutter guiding groove 145 and the belt unit 10, when the shutter guiding shaft 76 is in the area 1 of the shutter guiding groove 145, and show the state of the combination when the shutter guiding shaft 76 is in the area 1 of the shutter guiding groove 145. Part (a) of FIG. 17 shows the combination when the shutter 7 is in the open position. Part (b) of FIG. 17 shows the combination when the shutter 7 is in the closed position. It is desired that the belt unit 10 can be inserted into the apparatus main assembly 110 far enough for the frame positioning boss 45*b* to reach the position at which the frame positioning boss 45*b* fits into the frame guiding groove 143. Thus, the area 1 of the shutter guiding groove 145 is made relatively wide in terms of the top-bottom direction.

FIG. 18 shows the state of the combination described above, after the belt unit 10 has just been pushed into the apparatus main assembly 110 far enough for the shutter guiding shaft 76 to be in the area 2 of the shutter guiding groove 145. Ordinarily, at the beginning of the insertion of the belt unit 10 into the apparatus main assembly 110, the shutter 7 is in the closed position. Therefore, the shutter guiding shaft 76 moves through the area 1 of the shutter guiding groove 145 while remaining in the state shown in part (b) of FIG. 17. Thus, when the shutter guiding shaft 76 is moved from the area 1 of the shutter guiding groove 145 into the area 2 of the shutter guiding groove 145, it moves through the area 2, without causing any change to the state (open or closed) of the shutter 7. However, if the shutter 7 is in the open position for some reason or another when the belt unit 10 is inserted into the apparatus main assembly 110, the shutter guiding shaft 76 moves through the area 1 of the shutter guiding groove 145 while remaining in the state shown in part (a) of FIG. 7. In this case, as the shutter guiding shaft 76 moves into the area 2 of the shutter guiding groove 145, it is moved diagonally upward along the slanted surface 145*a*. Then, as it moves into the area 2 by a preset amount, the shutter 7 is moved into the closed position by the shutter mechanism of the toggle type, which was described above.

By the way, when the shutter guiding shaft 76 is in the area 1 of the shutter guiding groove 145, the frame positioning boss 45*b* and cleaning positioning boss 43*a* have not come under the restriction regarding upward and downward movement. That is, the area 1 is such an area that roughly guides the belt unit 10 when the belt unit 10 is inserted into the apparatus main assembly 110. It is not an area which strictly controls the belt unit 10 in movement (so that belt unit 10 is allowed to move only in preset direction along rail 140). Further, in this embodiment, at roughly the same time as the shutter guiding shaft 76 moves through the area 2 of the shutter guiding groove 145, the frame positioning boss 45*b* begins to be restricted in the top-bottom movement by the frame guiding groove 143. Therefore, the shutter guiding shaft 76 passes the area 2 of the shutter guiding groove 145 before the process of fitting the belt unit 10 into the rails 140 is completed.

FIG. 19 shows the state of the aforementioned combination, in which shutter guiding shaft 76 has just been moved next to the area 3 of the shutter guiding groove 145 through the area 2. During this period, the belt unit 10 is inserted toward the installation completion position, with the shutter 7 remaining held in the closed position. That is, a fourth area 4 (which hereafter may be referred to as area 4) of the shutter guiding groove 145, which is between the areas 2 and 3 of the shutter guiding groove 145, is such an area that prevents the shutter 7 from moving from the open position to the closed position, by preventing the shutter guiding shaft 76 from moving downward.

FIG. 20 shows the state of the combination while the shutter guiding shaft 76 is moving through the area 3 of the shutter guiding groove 145. As the belt unit 10 is inserted toward the installation completion position, the shutter guiding shaft 76 moves downward along the top tilted surface 145*b*. By the time when the shutter guiding shaft 76 moves through the area 3 of the shutter guiding groove 145, the shutter 7 will be in the open position.

FIG. 21 shows the state of the combination after the insertion of the belt unit 10 into the installation completion position. As the belt unit 10 is fitted into the rails 140 far enough to reach the installation completion position, the shutter guiding shaft 76 is separated from the shutter guiding groove 145. However, the shutter 7 is held in the open position.

The movement of the shutter 7, which occurs while the belt unit 10 is pulled out of the apparatus main assembly 110, is roughly opposite in direction from the movement of the shutter 7, which occurs while the belt unit 10 is inserted into the apparatus main assembly 110. That is, while the belt cleaning apparatus 6 is moved outward from the installation completion position, shown in FIG. 21, the shutter guiding shaft 76 enters the area 3 of the shutter guiding groove 145. Referring to FIG. 21, during the insertion of the belt unit 10 into the apparatus main assembly 110, the shutter guiding shaft 76 comes into contact with the top tilted surface 145*b*, whereas during the pullout of the belt unit 10 from the apparatus main assembly 110, the shutter guiding shaft 76 comes into contact with the bottom slanted surface 145*c*. Then, as the belt unit 10 is moved further outward, the shutter guiding shaft 76 is moved diagonally upward, whereby the shutter 7 is moved to the closed position. Thereafter, the shutter guiding shaft 76 moves through the area 4, area 2, and area 1 in the listed order. During this period, no change occurs to the state (open or closed) of shutter 7. Thus, the belt unit 10 comes out of the apparatus main assembly 110, with the shutter 7 remaining held in the closed position.

By the way, it is desired that the entrance portion of the shutter guiding groove 145, that is, the end portion (edge portion) of the bottom end portion of the top slanted surface 145*b*, and that of the bottom slanted surface 145*c*, are provided with a funnel-like portion 145*d* which is for guiding the shutter guiding shaft 76 into the shutter guiding groove 145. For example, the end portion of the bottom slanted surface 145*c* may be given such a shape that has curvature, as shown in FIG. 21. Further, for example, the shutter guiding groove 145 may be shaped so that the more upstream it is in terms of the belt unit insertion direction, the wider the gap between the top tilted surface 145*b* and bottom slanted surface 145*c* (gap may be tapered). By providing the shutter guiding groove 145 with the funnel-like portion 145*d* such as the one described above, it is possible to prevent the shutter guiding shaft 76 from hang up in the rail 140. Therefore, it is possible to make the belt unit 10 smoothly enter the apparatus main assembly 110. For example, in a case where the image forming apparatus 100 is structured so that the tension roller 2*c* doubles as the steering roller, the cleaning apparatus 6 tilts with the tension roller 2*c*. In this case, therefore, it sometimes occurs that the shutter guiding shaft 76 deviates upward or downward from the entrance portion of the shutter guiding groove 145 when the belt unit 10 is pulled out of the apparatus main assembly 110. Therefore, providing the entrance portion of the shutter guiding groove 145 with the funnel-like portion 145*d* is very effective to deal with the upward or downward deviation of the shutter guiding shaft 76.

FIG. 22 is a sectional view of the rail 140, as seen from the front side, at a plane perpendicular to the direction in which the belt unit 10 is fitted into the rails 140. Part (a) of FIG. 22 shows the rail 140 in this embodiment, which is structured so that its frame guiding groove 143, cleaning guiding groove 144, and shutter guiding groove 145 are independent from each other, and are different in position in terms of the top-bottom direction. That is, in this embodiment, the frame guiding groove 143, cleaning guiding groove 144, and shutter guiding groove 145 are separated from each other in terms of the top-bottom direction. However, it is possible to structure the rail 140 so that at least a part of the shutter guiding groove 145 is independent from the other guiding groove such as the frame guiding groove 143. In the case of this example, at least a part of the shutter guiding groove 145 overlaps with the frame guiding groove 143 in terms of the top-bottom direction. In terms of the direction which is inter-sectional (roughly perpendicular, in this embodiment) to the belt unit insertion direction, however, it is different in position from the other guiding groove, but is continuous to the other guiding groove. Whether the guiding groove is to be divided in terms of the height direction or depth direction has only to be decided in consideration of the size of the internal space of the image forming apparatus.

Parts (a) to (c) of FIG. 23 are sectional views of the aforementioned combination of the belt unit 10, rail 140, etc., as seen from the direction which is parallel to the rotational axis of the shutter 7, and are for describing the angle of the slanted surface 145*a*, that of the top tilted surface 145*b*, and that of the bottom slanted surface 145*c*, relative to the straight line Lc which coincides with the rotational center 71*a* of the shutter 7 and the center of the shutter guiding shaft 76. Part (a) of FIG. 23 shows the angle θ of the slanted surface 145*a* when the belt unit 10 is inserted into the apparatus main assembly 110 while the shutter 7 is in the open position. Part (b) of FIG. 23 shows the angle θ2 of the top tilted surface 145*b* while the belt unit 10 is inserted into the apparatus main assembly 110. Part (c) of FIG. 23 shows the angle of the bottom slanted surface 145*c* (guiding surface) while the belt unit 10 is pulled out of the apparatus main assembly 110. These angles correspond to the point in time when the shutter guiding shaft 76 begins to contact the corresponding guiding surfaces.

These angles θ1, θ2, and θ3 affect the ease with which the belt unit 10 can be inserted into, or pulled out of, the apparatus main assembly 110. If the angles θ1, θ2, and θ3 are 90°, the shutter guiding shaft 76 squarely hits each of the three surfaces, and, therefore, it is impossible for the shutter 7 to be opened or closed. By making the angles θ1, θ2, and θ3 as small as possible, it is possible to improve the image forming apparatus 100 in terms of the ease with which the belt unit 10 can be inserted into, or pulled out of, the apparatus main assembly 110. In this embodiment, the angle θ1 is set to 28.3°, the angle θ2 is set to 44.8°, and the angle θ3 is set to 21.5°. That is, each of the angles θ1, θ2, and θ3 is set to be no more than 45°.

As described above, also in the case of the combination of the image forming apparatus 100 and the belt unit 10, which are structured as described above, if the belt unit 10 is inserted into the apparatus main assembly 110, with the shutter 7 remaining in the open position, for some reason or another, the shutter 7 is closed in the area 2 of the shutter guiding groove 145. If the belt unit 10 is inserted into the apparatus main assembly 110 while the shutter 7 is in the open position, toner and the like contaminants fall out of the toner discharge opening 67*a* of the belt unit 10. Thus, the belt unit 10 moves to the installation completion position while contaminating the interior of the apparatus main assembly 110. This contamination of the interior of the apparatus main assembly 110 affects such image formation processes as the charging process, exposing process, and developing process, resulting sometimes in the formation of images which suffer from unwanted shadowy streaks. In comparison, in this embodiment, even if the belt unit 10 is inserted into the apparatus main assembly 110 while the shutter 7 is in the open position, the shutter 7 is closed in the passage through which it is inserted to the installation completion position. In particular, in this embodiment, the shutter 7 which is in the open position is made to move into the closed position, in the early stage of the insertion of the belt unit 10 into the apparatus main assembly 110, that is, at roughly the same time as when an operator begins to insert the belt unit 10 into the apparatus main assembly 110, beyond the rough guide (area 1) of the rail 140. Therefore, it is prevented that toner leaks from the toner discharge opening 67*a* while the belt unit 10 is inserted deeper into the apparatus main assembly 110. Therefore, it is possible to prevent the problem that the interior of the apparatus main assembly 110 is contaminated by the toner from the belt unit 10. Further, in this embodiment, the problem that the shutter 7 which is in the closed position is moved to the open position while it reaches the area 3 (shutter moving (opening-closing) portion of the shutter guiding groove 145, is prevented by the area 4 of the shutter guiding groove 145.

By the way, even if the relationship between the rotational direction of the shutter 7, and the change in the state of the shutter 7, that is, whether the shutter 7 is open or closed, becomes opposite from that in the second embodiment described above, effects similar to those obtainable by the second embodiment can be obtained by changing the shutter guiding groove 145 in shape according to the change in the relationship described above.

[Miscellanies]

In the foregoing, the present invention was described with reference to preferred embodiments of the present invention. However, these embodiments are not intended to limit the present invention in scope.

In the preceding embodiments described above, the belt unit was structured so that the shutter is made to rotationally move between the open position and closed position. These embodiments, however, are not intended to limit the present invention in scope. For example, the belt unit may be structured so that the shutter is made to linearly shuttle between the open position and closed position.

In the preceding embodiments described above, the holding means which is capable of holding the shutter in either of the open position and closed position had a pressing means which keeps the shutter pressed toward the open position or closed position, according to the direction in which the shutter is moved. These embodiments, however, are not intended to limit the present invention in scope. For example, the belt unit may be structured so that the shutter is open or closed against friction, and the friction is large enough to keep the shutter in the open position or closed position.

In the embodiments described above, the intermediary transfer belt was an endless belt. The present invention, however, is also compatible with a photosensitive belt, an electrostatically recordable dielectric belt, or the like, as long as they are endless, and toner adheres to them. Application of the present invention to these endless belts yields similar effects to those obtainable by the embodiments described above.

Further, in the embodiments described above, the image forming apparatus was structured so that the endless belt, suspended and tensioned by multiple suspending-tensioning rollers, and the belt cleaning apparatus, are installed together, or uninstalled together, into or out of the belt unit chamber in the main assembly of the image forming apparatus. In a case where the belt cleaning apparatus is supported by one of the pairs of belt supporting-tensioning rollers, for example, the problems attributable to the pressure which is continuously applied to the shutter 7 in the apparatus main assembly might manifest. Thus, the effects of the present invention are manifested in a case where an image forming apparatus is structured so that the belt cleaning apparatus can be installed into, or uninstalled from, the apparatus main assembly, as a part of the belt unit. However, the belt cleaning apparatus is such an apparatus that acts on the belt by being placed in contact with the belt in the main assembly of an image forming apparatus. Therefore, even if the image forming apparatus is structured so that the belt cleaning apparatus can be installed into, or pulled out of the main assembly, independently from the belt unit, it is possible that the pressure for pressing the shutter in the apparatus main assembly will affect the movement of the belt, if the image forming apparatus is structured so that the pressure continuously presses the shutter in the apparatus main assembly. Therefore, the present invention is applicable to any apparatus as long as the apparatus is structured so that one of its units having a belt cleaning apparatus is removably mountable in the apparatus main assembly. The effects of such application are the same as those obtainable by the embodiments described above.

Further, the preceding embodiments are not intended to limit the present invention in terms of the direction in which the belt cleaning apparatus which is removably installable, as a part of the belt unit, or independently from the belt unit, is installed in the main assembly of an image forming apparatus. That is, these embodiments are not intended to limit the present invention in terms of the direction in which the belt cleaning apparatus is inserted into, or pulled out of, the apparatus main assembly. In other words, not only is the present invention applicable to an image forming apparatus structured so that the direction in which the belt unit is inserted into, or pulled out of, the apparatus main assembly, is inter-sectional (roughly perpendicular, in embodiments described above) to the rotational axes of the belt suspending-tensioning rollers, but also, an image forming apparatus structured so that the direction is roughly parallel to the these rotational axes.

INDUSTRIAL APPLICABILITY

According to the present invention, it is possible to provide an image forming apparatus, the belt cleaning apparatus and waste toner conveyance passage of which are correctly connected to each other.

What is claimed is:

1. An image forming apparatus comprising: a unit detachably mounted on a main assembly of said apparatus and including a belt, a cleaning device, a shutter member, and a holding member, wherein said belt is an endless belt and is stretched around a plurality of stretching rollers, wherein said cleaning device includes a cleaning member for removing toner from said belt and a container for accommodating the toner removed from said belt and provided with a discharge opening, and wherein said shutter member is movable between an opening position for opening said discharge opening and a closing position for closing said discharge opening, to open and close said discharge opening, and wherein said holding member holds said shutter member at the opening position or the closing position; and a guiding portion for guiding said unit and actable on said shutter member to open and close said shutter member when said unit is mounted to and dismounted from said main assembly, wherein said guiding portion includes an opening operating portion, a closing operating portion, and a shutter closing portion, wherein said opening operating portion is contacted to said shutter member to move said shutter member from the closing position to the opening position in interrelation with an inserting operation of said unit relative to said guiding portion, wherein said closing operating portion is contacted to said shutter member to move said shutter member from the opening position to the closing position in interrelation with an extracting operation of said unit from said guiding portion, and wherein, when said unit is inserted relative to said guiding portion while said shutter member is in the opening position, said shutter closing portion is contacted to said shutter member at a position upstream of said opening operating portion and said closing operating portion, with respect to an inserting direction of said unit relative to said guiding portion, to move said shutter member from the opening position to the closing position in interrelation with the inserting operation.

2. The apparatus according to claim 1, wherein said shutter member is held without contact with said opening operating portion after being moved to the opening position by said opening operating portion, and said shutter member is held at the closing position in a state that said unit is extracted from said main assembly, after being moved to the closing position by said closing operating portion.

3. The apparatus according to claim 1, wherein said holding member includes an urging member, and wherein, when said shutter member moves to an opening position side beyond a predetermined position in an operating direction of said shutter member, said urging member urges said shutter member toward the opening position side, and, when said shutter member moves to a closing position side beyond the predetermined position, said urging member urges said shutter member to the closing position side.

4. The apparatus according to claim 1, wherein said unit is provided with a first portion-to-be-guided provided on a part other than said shutter member, and a second portion-to-be-guided provided on said shutter member, wherein said guiding portion is provided with a first guide portion for guiding said first portion-to-be-guided when said unit is mounted to or dismounted from said main assembly, and is provided with a second guide portion for guiding said second portion-to-be-guided when said unit is mounted to or dismounted from said main assembly, wherein said second guide portion includes a first area to be passed by said shutter member irrespective of whether said shutter member is in the opening position or the closing position, when said shutter member moves in the inserting direction, a second area for moving said shutter member from the opening position to the closing position when said shutter member passes by the second area in the inserting direction, and a third area for moving said shutter member from the closing position to the opening position when said shutter member passes by the third area in the inserting direction, and for moving said shutter member from the opening position to the closing position, wherein said shutter member passes by the third area in the extracting direction, wherein the first the area, the second area, and the third area are provided in the order named from an upstream side in the inserting direction, and wherein said shutter closing portion is provided in the second area of said second guide portion, and said opening operating portion and said closing operating portion are provided in the third area of said second guide portion.

5. The apparatus according to claim 4, wherein said second guide portion is provided with a fourth area for preventing movement of said shutter member from the closing position to the opening position, the fourth area being provided between the second area and the third area in the inserting direction.

6. The apparatus according to claim 4, wherein at least a part of said second guide portion is provided continuously with said first guide portion at a position overlapping with said first guide portion in a vertical direction and not overlapping with said first guide portion in a widthwise direction crossing with the inserting direction of said unit.

7. The apparatus according to claim 1, wherein said shutter closing portion is provided on a unit insertion starting position side of a center position in a movement path of said unit in said guiding portion.

8. The apparatus according to claim 1, wherein said opening operating portion and said closing operating portion are provided on a unit mounting completion position side of a center position in a movement path of said unit in said guiding portion.

9. The apparatus according to claim 1, wherein said cleaning member contacts said belt on a side of said belt opposite from a side where a tension roller of said stretching rollers contacts said belt, said tension roller applying tension to said belt.

10. The apparatus according to claim 9, wherein said tension roller is inclinable to change an alignment relative to at least one of another roller of said stretching rollers to adjust a position of said belt in a widthwise direction.

* * * * *